US012172785B2

(12) United States Patent
Lee et al.

(10) Patent No.: US 12,172,785 B2
(45) Date of Patent: Dec. 24, 2024

(54) SHIELDING BAG GRIPPING APPARATUS, DISPLAY PACKING SYSTEM INCLUDING THE SAME, AND DISPLAY PACKING METHOD USING THE SAME

(71) Applicant: Samsung Display Co., Ltd., Yongin-si (KR)

(72) Inventors: Kiwook Lee, Asan-si (KR); Youngmyo Hwang, Asan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 72 days.

(21) Appl. No.: 17/840,830

(22) Filed: Jun. 15, 2022

(65) Prior Publication Data

US 2023/0077955 A1 Mar. 16, 2023

(30) Foreign Application Priority Data

Sep. 13, 2021 (KR) ..... 10-2021-0122014

(51) Int. Cl.
*B65B 41/14* (2006.01)
*B65B 5/02* (2006.01)
(Continued)

(52) U.S. Cl.
CPC ..... *B65B 41/14* (2013.01); *B65B 5/022* (2013.01); *B65B 5/045* (2013.01); *B65B 31/046* (2013.01);
(Continued)

(58) Field of Classification Search
CPC B65B 5/022; B65B 5/045; B65B 9/13; B65B 23/00; B65B 31/048; B65B 41/14;
(Continued)

(56) References Cited

U.S. PATENT DOCUMENTS 1,995,259 A * 3/1935 Becker ..... B65B 43/30 493/313
2,281,516 A * 4/1942 Royal ..... B65B 43/30 53/578
(Continued)

FOREIGN PATENT DOCUMENTS

KR 1020080109955 A 12/2008
KR 10-1048414 B1 7/2011
KR 1020170132061 A 12/2017

*Primary Examiner* — Robert F Long
*Assistant Examiner* — Eduardo R Ferrero
(74) *Attorney, Agent, or Firm* — CANTOR COLBURN LLP

(57) ABSTRACT

A shielding bag gripping apparatus includes a first suction part extending in a first direction, a second suction part extending in the first direction and spaced apart from the first suction part in a second direction crossing the first direction, a first compression part below the first suction part, and a second compression part below the second suction part. The first suction part may include a first suction surface having a normal line parallel to the second direction, a first suction hole exposed by the first suction surface and a first placement hole vertically penetrating the first suction part, and the second suction part may include a second suction surface facing the first suction surface and a second suction hole exposed by the second suction surface.

7 Claims, 16 Drawing Sheets

(51) Int. Cl.
*B65B 5/04* (2006.01)
*B65B 31/04* (2006.01)
*B65B 51/30* (2006.01)
*B65B 55/00* (2006.01)
*B65B 61/06* (2006.01)

(52) U.S. Cl.
CPC ..... *B65B 31/048* (2013.01); *B65B 51/30* (2013.01); *B65B 55/00* (2013.01); *B65B 61/06* (2013.01)

(58) Field of Classification Search
CPC ..... B65B 43/123; B65B 43/267; B65B 43/30; B65B 43/465; B65B 51/146; B65B 51/30; B65B 55/00; B65B 61/06; B65B 31/041; B65B 31/042; B65B 31/043; B65B 31/046
USPC .... 53/459, 570, 512, 468, 386.1, 434, 284.7
See application file for complete search history.

(56) References Cited

U.S. PATENT DOCUMENTS 2,347,902 A * 5/1944 Gaubert ..... B31B 70/00 493/194
2,577,386 A * 12/1951 Vergobbi ..... B65B 43/30 493/248
2,689,073 A * 9/1954 Twigg ..... B65B 57/06 222/525
2,757,842 A * 8/1956 Gaubert ..... B65B 43/30 222/61
2,927,410 A * 3/1960 Doyen ..... B65B 3/32 53/374.8
2,964,892 A * 12/1960 Grosjean ..... B65B 43/18 53/571
3,446,121 A * 5/1969 Fritz ..... B65B 43/30 493/313
3,465,499 A * 9/1969 Nelson ..... B65B 43/30 53/571
3,501,893 A * 3/1970 Peterson ..... B65B 43/18 53/386.1
3,566,578 A * 3/1971 Hargrave ..... B65B 43/18 53/386.1
3,577,704 A * 5/1971 Lense ..... B65B 43/30 53/386.1
3,676,977 A * 7/1972 Rothmann ..... B65B 43/30 53/526
3,688,471 A * 9/1972 Clark ..... B65B 43/18 53/571
3,785,414 A * 1/1974 Obara ..... B65B 43/18 141/114
3,830,038 A * 8/1974 Propst ..... B65B 43/18 53/77
3,934,388 A * 1/1976 Stadlbauer ..... B65B 43/30 53/571
3,939,624 A * 2/1976 Gidewall ..... B65B 25/067 53/512
3,968,629 A * 7/1976 Gidewall ..... B65B 25/067 53/374.8
3,982,377 A * 9/1976 Vanderpool ..... B65B 25/20 53/66
4,086,746 A * 5/1978 Christy ..... B65B 43/30 53/571
4,094,125 A * 6/1978 Gess ..... B65B 5/022 53/567
4,115,978 A * 9/1978 Langemeyer ..... B65B 43/12 53/386.1
4,244,159 A * 1/1981 Gess ..... B65B 5/022 53/381.2
4,280,313 A * 7/1981 Akkala ..... B65B 43/30 493/186
4,320,615 A * 3/1982 Gmur ..... B65B 43/30 53/67
4,345,629 A * 8/1982 Inglett, Jr. ..... B65B 43/18 53/586
4,373,319 A * 2/1983 Pullen ..... B65B 25/002 53/284.7
4,510,736 A * 4/1985 Muller ..... B65B 51/32 53/284.7
4,534,158 A * 8/1985 McClosky ..... B65B 1/02 53/562
4,548,826 A * 10/1985 Watkins ..... B65D 81/34 53/370.7
4,581,874 A * 4/1986 Rechtsteiner ..... B65B 55/027 53/433
4,674,268 A * 6/1987 Gavronsky ..... B29C 44/182 141/10
4,726,170 A * 2/1988 Sawa ..... B65B 43/123 53/386.1
4,795,413 A * 1/1989 Johnson ..... B65B 43/30 53/385.1
4,823,538 A * 4/1989 Takamura ..... B65B 43/30 53/284.7
4,912,907 A * 4/1990 Fang ..... B65B 43/465 53/512
5,070,677 A * 12/1991 Hicks ..... B65B 5/067 53/445
5,337,541 A * 8/1994 Gmuer ..... B65B 43/30 53/386.1
6,282,871 B1 * 9/2001 Killinger ..... B65B 43/123 53/469
10,654,603 B2 * 5/2020 Harth ..... B65B 43/18
11,260,998 B2 * 3/2022 Jung ..... B65B 31/043
2006/0207225 A1 * 9/2006 Fukuda ..... B65B 43/30 53/386.1
2008/0086984 A1 * 4/2008 Andria ..... B65B 31/048 53/436
2009/0256471 A1 * 10/2009 Kim ..... H10K 50/84 313/504
2010/0006175 A1 * 1/2010 Shinagawa ..... B65B 3/22 141/7
2010/0192524 A1 * 8/2010 Rapparini ..... B65B 31/024 53/284.7
2010/0288394 A1 * 11/2010 Larsen ..... B65B 43/465 141/10
2012/0111449 A1 * 5/2012 Hsu ..... B65B 57/00 62/340
2013/0016924 A1 * 1/2013 Helmsderfer ..... B65B 31/048 383/68
2014/0215969 A1 * 8/2014 Parthun ..... B65B 55/16 53/111 R
2014/0374704 A1 * 12/2014 Jang ..... H10K 59/12 438/23
2015/0203222 A1 * 7/2015 Zonato ..... B65B 31/042 53/455
2015/0274336 A1 * 10/2015 Kaneko ..... B65B 43/18 53/79
2017/0036793 A1 * 2/2017 Harth ..... B65B 43/30
2017/0143015 A1 * 5/2017 Brouwer ..... A23L 3/04
2017/0203867 A1 * 7/2017 Shook ..... B65B 65/02
2018/0251245 A1 * 9/2018 Jung ..... B29C 66/43121
2019/0152630 A1 * 5/2019 Kuraoka ..... B65C 9/08

* cited by examiner

SHIELDING BAG GRIPPING APPARATUS, DISPLAY PACKING SYSTEM INCLUDING THE SAME, AND DISPLAY PACKING METHOD USING THE SAME

This application claims priority to Korean Patent Application No. 10-2021-0122014, filed on Sep. 13, 2021, and all the benefits accruing therefrom under 35 U.S.C. § 119, the entire contents of which are hereby incorporated by reference.

BACKGROUND

(1) Field

The present disclosure herein relates to a shielding bag gripping apparatus, a display packing system including the same, and a display packing method using the same.

(2) Description of the Related Art

A display may be manufactured (or provided) through various processes. A finished display may be assembled with an external component. For this, a display may be transported within the various processes.

SUMMARY

A display may be damaged or contaminated while being transported within various processes during providing of a display and/or an electronic device including the same. To prevent such damage or contamination, the display may be inserted into a shielding bag before and/or during transporting of the display. That is, a display may be packed within a shielding container such as a bag. The present disclosure provides a shielding bag gripping apparatus capable of packing a display automatically into a shielding container, a display packing system including the same, and a display packing method using the same.

An embodiment of the invention provides a shielding bag gripping apparatus which includes a first suction part extending in a first direction, a second suction part extending in the first direction and spaced apart from the first suction part in a second direction crossing the first direction, a first compression part below the first suction part, and a second compression part below the second suction part. The first suction part includes a first suction surface having a normal line parallel to the second direction, a first suction hole exposed by the first suction surface, and a first placement hole vertically penetrating the first suction part. The second suction part includes a second suction surface facing the first suction surface, and a second suction hole exposed by the second suction surface.

In an embodiment of the invention, a display packing system includes a shielding bag feeder, and a shielding bag gripping apparatus which grips a shielding bag fed from the shielding bag feeder. The shielding bag gripping apparatus includes a first suction part, a second suction part spaced apart from the first suction part, a suction pump and a nozzle, the first suction part includes a first suction surface, a first suction hole connected to the suction pump and exposed by the first suction surface, and a first placement hole vertically penetrating the first suction part. The second suction part includes a second suction surface facing the first suction surface, and a second suction hole connected to the suction pump, and exposed by the second suction surface. The nozzle may be selectively inserted into the first placement hole.

In an embodiment of the invention, a display packing method includes feeding, by a shielding bag feeder, a shielding bag, gripping, by a shielding bag gripping apparatus, the shielding bag, opening, by the shielding bag gripping apparatus, an upper end of the shielding bag, inserting a display into the shielding bag of which the upper end is opened, suctioning air in the shielding bag into which the display is inserted, and heat-compressing the upper end of the shielding bag into which the display is inserted.

BRIEF DESCRIPTION OF THE FIGURES

The accompanying drawings are included to provide a further understanding of the invention, and are incorporated in and constitute a part of this specification. The drawings illustrate embodiments of the invention and, together with the description, serve to explain principles of the invention. In the drawings.

DETAILED DESCRIPTION

Figure 1:
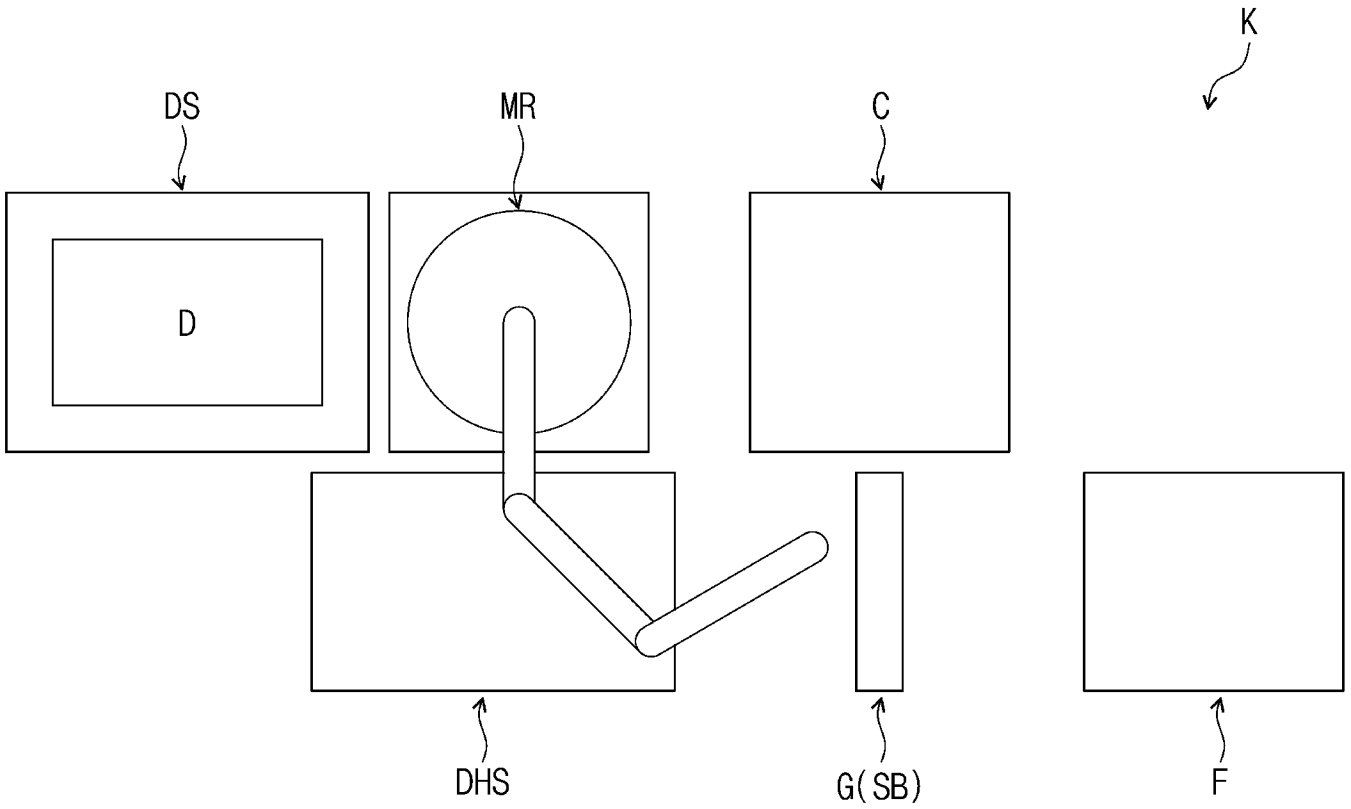
FIG. 1 is a schematic view illustrating a display packing system according to an embodiment.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

In this specification, when a component (or region, layer, portion, etc.) is referred to as being related to another element such as being "on", "connected", or "coupled" to another component, it means that it is placed/connected/coupled directly on the other component or a third component can be disposed between them. In contrast, when a component (or region, layer, portion, etc.) is referred to as being related to another element such as being "directly on", "directly connected", or "directly coupled" to another component, it means that no intervening (e.g., third) component is disposed therebetween.

The same reference numerals or symbols refer to the same elements. As used herein, a reference number may indicate a singular element or a plurality of the element. For example, a reference number labeling a singular form of an element within the drawing figures may be used to reference a plurality of the singular element within the text of specification. In addition, in the drawings, thicknesses, ratios, and dimensions of components are exaggerated for effective description of technical content. "And/or" includes all combinations of one or more that the associated elements may define.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or."

Terms such as first and second may be used to describe various components, but the components should not be limited by the terms. These terms are only used for the purpose of distinguishing one component from other components. For example, without departing from the scope of the invention, a first component may be referred to as a second component, and similarly, a second component may be referred to as a first component. Singular expressions include plural expressions unless the context clearly indicates otherwise.

In addition, terms such as "below", "lower", "above", and "upper" are used to describe the relationship between components shown in the drawings. The terms are relative concepts and are described based on the directions indicated in the drawings.

Terms such as "include" or "have" are intended to designate the presence of a feature, number, step, action, component, part, or combination thereof described in the specification, and it should be understood that it does not preclude the possibility of presence or addition of one or more other features, numbers, steps, operations, components, parts, or combinations thereof.

Unless otherwise defined, all terms (including technical and scientific terms) used in this specification have the same meaning as commonly understood by one of ordinary skill in the art to which this invention belongs. In addition, terms such as terms defined in commonly used dictionaries should be interpreted as having a meaning consistent with the meaning having in the context of the related technology, and should not be interpreted as too ideal or too formal unless explicitly defined here.

Hereinafter, one or more embodiment of a shielding bag gripping apparatus G, a display packing system K including the same, and a display packing method S using the same will be described with reference to the accompanying drawings.

FIG. 1 is a schematic view illustrating a display packing system K according to an embodiment.

Referring to FIG. 1, a display packing system K may be provided. The display packing system K may be a device which wraps a display D such as an electronic device or apparatus which provides an image, with a packing material. More particularly, the display packing system K may be a device which wraps a display D with a shielding bag SB in order to protect a finished display from an external impact, a contaminant, and/or the like. The finished display may mean a display D which is not yet coupled to an external housing, etc. According to the display packing system K, a display D may be automatically packed within a shielding bag SB. The display packing system K may store, in a case housing C, a display D packed within a shielding bag SB.

The display packing system K may include a display transport part DS (e.g., transporter), a robot arm MR, a dehumidifying agent supply part DHS (e.g., dehumidifying agent supplier), a shielding bag feeder F, and a shielding bag gripping apparatus G (e.g., shielding bag gripper). The shielding bag SB (or shielding bag material) may be provided to components of the display packing system K, along a feeding direction. In an embodiment, the shielding bag gripping apparatus G may follow the shielding bag feeder F in the feeding direction.

The display transport part DS may transport a display D relative to various components of the display packing system K. That is, the display D may be movable together with and by the display transport part DS. More particularly, the display transport part DS may transport a display D so that the display D is accessible to the robot arm MR, such as to be picked up by the robot arm MR. For this, the display transport part DS may include various components capable of transporting the display D relative to the various stations of the display packing system K. In an embodiment, for example, the display transport part DS may include a conveyer structure. However, the invention is not limited thereto.

The robot arm MR may move a display D to be insertable into a shielding bag SB. More particularly, the robot arm MR may pick up the display D from the display transport part DS, and insert the display D into a shielding bag SB gripped by the shielding bag gripping apparatus G at the case housing C. For this, the robot arm MR may include an articulated robot arm structure.

The dehumidifying agent supply part DHS may supply a dehumidifying agent into a shielding bag SB. In an embodiment, for example, the dehumidifying agent supply part DHS may input a dehumidifying agent into the shielding bag SB gripped by the shielding bag gripping apparatus G. The dehumidifying agent supplied by the dehumidifying agent supply part DHS may mean silica-gel, etc.

The shielding bag feeder F may supply a shielding bag SB within the display packing system K. In an embodiment, for example, the shielding bag feeder F may supply a shielding bag SB so the shielding bag SB is accessible or grippable by the shielding bag gripping apparatus G. More detailed description of the shielding bag feeder F will be made later with reference to FIG. 2.

The shielding bag gripping apparatus G may grip a shielding bag SB. In an embodiment, for example, the shielding bag gripping apparatus G may grip a shielding bag SB supplied from the shielding bag feeder F, and move the shielding bag SB to the case housing C. That is, the shielding bag gripping apparatus G may be movable relative to other stations of the display packing system K, such as the shielding bag feeder F, the case housing C, etc. The shielding bag SB is movable together with the shielding bag gripping apparatus G. In addition, the shielding bag gripping apparatus G may open the shielding bag SB, such as at upper ends of the shielding bag SB. The shielding bag gripping apparatus G may seal the shielding bag SB, such as at the upper ends thereof, by heat-compression. That is, the shielding bag SB is openable and closeable (or sealable), by the shielding bag gripping apparatus G, such that the shielding bag gripping apparatus G is a shielding bag opener, closer, sealer, etc. More detailed description of the shielding bag gripping apparatus G will be made later with reference to FIG. 5.

Figure 2:
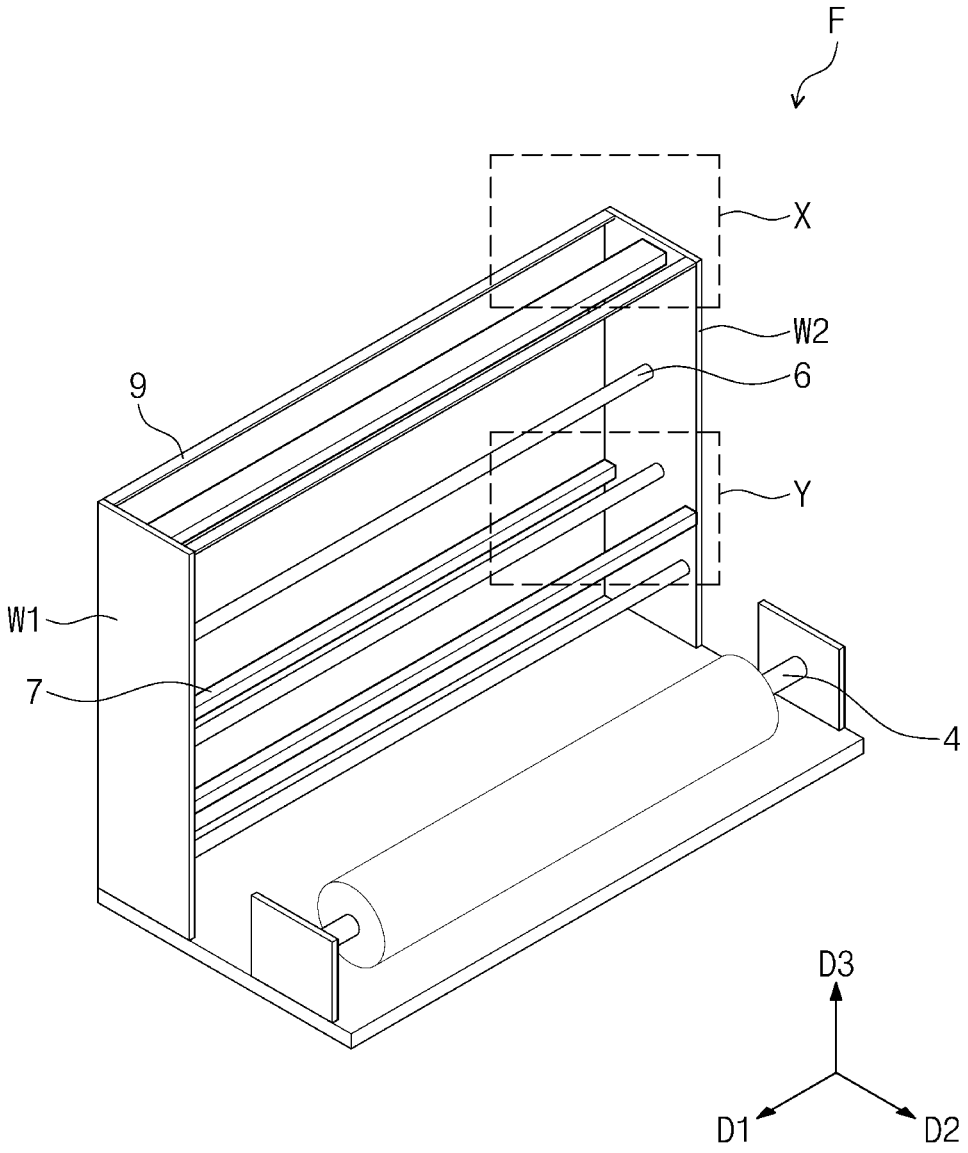
FIG. 2 is a perspective view illustrating a shielding bag feeder according to an embodiment.

FIG. 2 is a perspective view illustrating a shielding bag feeder F according to an embodiment.

Hereinafter, in FIG. 2, D1 may be referred to as a first direction, D2 may be referred to as a second direction crossing the first direction D1, and D3 may be referred to as a third direction crossing each of the first direction D1 and the second direction D2. The first direction D1 and the second direction D2 may be each referred to as a horizontal direction. A plane may be defined by the first direction D1 and the second direction D2 which cross each other. In addition, the third direction D3 may also be referred to as a vertical direction.

Referring to FIG. 2, the shielding bag feeder F may include a first wall W1, a second wall W2, a supply roller 4, a conveying roller 6, a lower compression part 7 (e.g., lower compressor), and a cutting part 9 (e.g., cutter). The first wall W1 and the second wall W2 may extend from and be connected to a base. The first wall W1 and the second wall W2 may be connected to the base at lower ends of the respective walls. In an embodiment, upper ends of the first wall W1 and the second wall W2 may be connected to each other by a support bar extended therebetween, such as that shown in FIG. 2 between two cutting blades to be described later.

The first wall W1 and the second wall W2 may face each other. More particularly, the first wall W1 and the second wall W2 may face each other in a state of being spaced apart by a distance in the first direction D1. The first wall W1 and the second wall W2 may support the conveying roller 6, the lower compression part 7, and the cutting part 9. The conveying roller 6, the lower compression part 7, and the cutting part 9 may each be connected to the first wall W1 and the second wall W2.

The supply roller 4 may have a cylindrical shape extending in the first direction D1. The supply roller 4 may be rotatably connected to a third wall and a fourth wall facing each other along the first direction D1. The third wall and the fourth wall may extend from and be connected to the base (e.g., a same base or different base from which the first wall W1 and the second wall W2 extend.

The supply roller 4 may supply a shielding bag SB. More particularly, in a state in which a shielding bag material from which the shielding bag SB is provided, is rolled around the supply roller 4 (e.g., roll of shielding bag material), the supply roller 4 may, while rotating, supply the shielding bag SB to the conveying roller 6. That is, the supply roller 4 connected to the first wall W1 and the second wall W2 may be rotatable about an axis extended along the first direction D1 The shielding bag SB material supplied by the supply roller 4 may be a vinyl-type component that protects a display D from an external impact, a contaminant, and/or the like. In an embodiment, for example, the shielding bag material may have a ring shape that provides a space therein. The ring-shaped shielding bag material may have a ring-shape which vertically extends. Accordingly, the inner space of the shielding bag material may vertically extend to have a cylindrical shape. The roll of shielding bag material may be flat along the supply roller 4 and open along a feeding direction. That is, the roll of shielding bag material which is flat on the supply roller 4 may dispose two layers of material facing each other and unbonded to each other, in a direction away from the body of the supply roller 4.

The conveying roller 6 may be located between the first wall W1 and the second wall W2. The conveying roller 6 may extend in the first direction D1. The conveying roller 6 may convey a shielding bag SB upwards. More particularly, the conveying roller 6 may convey the shielding bag SB upwards, while rotating in contact with the shielding bag SB supplied by the supply roller 4. The conveying roller 6 may be rotatably connected to the first wall W1 and the second wall W2. The conveying roller 6 may be provided in plurality. A plurality of conveying rollers 6 may be disposed vertically spaced apart from each other (e.g., along the third direction D3). However, hereinafter, a singular one of the conveying roller 6 will be described as being single, for convenience.

The lower compression part 7 may be located between the first wall W1 and the second wall W2. The lower compression part 7 may extend in the first direction D1. The lower compression part 7 may heat-compress the shielding bag SB by selectively contacting the shielding bag SB. The lower compression part 7 may be located between adjacent rollers among the plurality of conveying rollers 6 as illustrated in FIG. 2, but is not limited thereto. That is, the lower compression part 7 may be located below the conveying roller 6 (e.g., closer to the base), or located above the conveying roller 6 (e.g., further from the base). A more detailed description of the lower compression part 7 will be made later with reference to FIG. 4.

The cutting part 9 may be located between the first wall W1 and the second wall W2. The cutting part 9 may extend in the first direction D1. The cutting part 9 may cut a shielding bag SB by selectively contacting the shielding bag SB. The cutting part 9 may be located above the conveying roller 6 as illustrated in FIG. 2, but is not limited thereto. That is, the cutting part 9 may be located below the conveying roller 6, or located between the plurality of conveying rollers 6. A more detailed description of the cutting part 9 will be made later with reference to FIG. 3.

Figure 3:
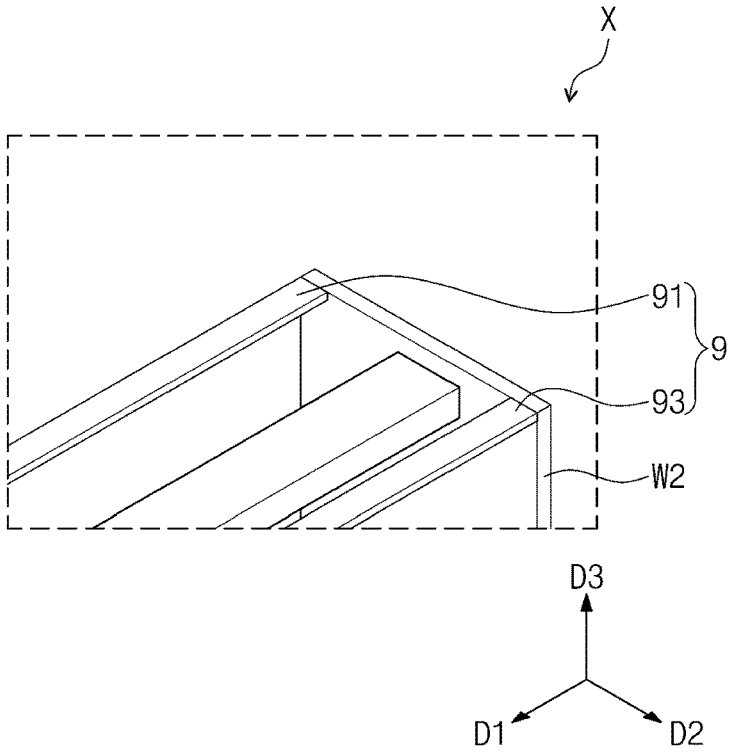
FIG. 3 is an enlarged perspective view of a part X in FIG. 2.

FIG. 3 is an enlarged perspective view of a part X in FIG. 2.

Referring to FIGS. 3 and 2, the cutting part 9 may include a first cutting blade 91 and a second cutting blade 93. The first cutting blade 91 and the second cutting blade 93 may each extend in the first direction D1, between the first wall W1 and the second wall W2. The first cutting blade 91 and the second cutting blade 93 may be spaced apart from each other in the second direction D2. The first cutting blade 91 and the second cutting blade 93 may each move in the second direction D2. That is, the first cutting blade 91 and the second cutting blade 93 may be movable along the second direction D2, in a direction toward each other and in a direction away from each other.

For movement of the blades relative to each other, an actuator, such as a slide structure and a motor, for guiding the movement of the first cutting blade 91 and the second cutting blade 93, may be provided. That is, the cutting part 9 may further include the actuator, such as the slide structure and the motor, for guiding the movement of the first cutting blade 91 and the second cutting blade 93. The first cutting blade 91 may move in the second direction D2, and the second cutting blade 93 may move in a direction opposite to the second direction D2, so that the first cutting blade 91 and the second cutting blade 93 may get closer to each other. When a shielding bag SB is located between the first cutting blade 91 and the second cutting blade 93, the shielding bag SB may be cut by the first cutting blade 91 and the second cutting blade 93 which get closer to each other and contact the roll of shielding bag material at a cutting location.

Figure 4:
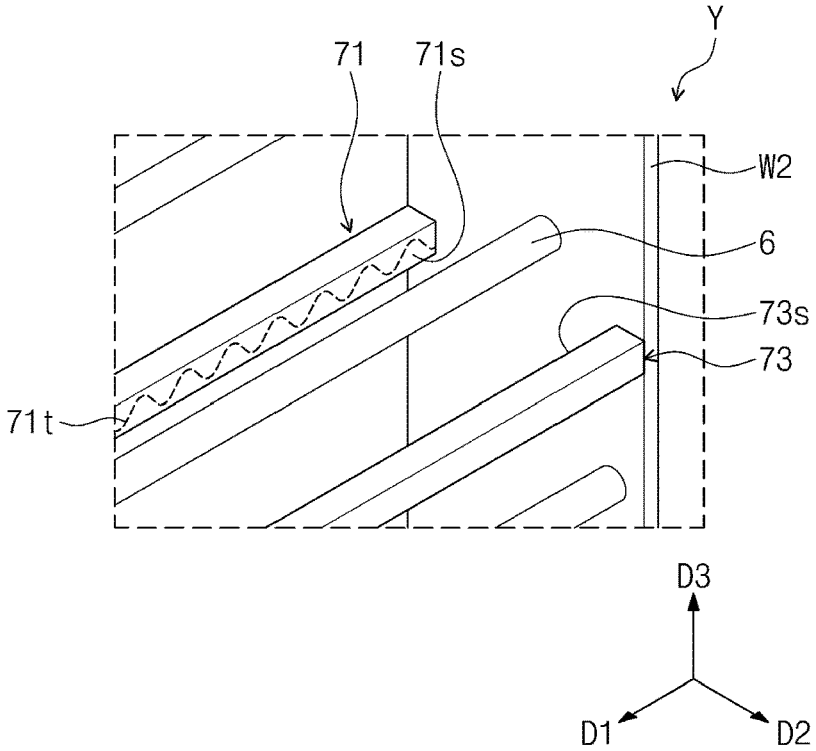
FIG. 4 is an enlarged perspective view of a part Y in FIG. 2.

FIG. 4 is an enlarged perspective view of a part Y in FIG. 2.

Referring to FIGS. 4 and 2, the lower compression part 7 may include a first lower compression part 71 (e.g., first sealing bar) and a second lower compression part 73 (e.g., second sealing bar). The first lower compression part 71 and the second lower compression part 73 may each extend in the first direction D1, between the first wall W1 and the second wall W2. The first lower compression part 71 may include a first lower heater 71*t*. The first lower heater 71*t* may mean a component that emits heat to the surroundings thereof. In an embodiment, for example, the first lower heater 71*t* may mean a resistance line (e.g., electrical resistance line) that emits Joule heat when (electrical) current flow therethrough. However, the invention is not limited thereto, and the first lower heater 71*t* may mean another component capable of emitting heat to the surroundings. The heat generated by the first lower heater 71*t* may be emitted to outside the first lower compression part 71, by a first lower compression surface 71*s* (e.g., first heatable surface).

The second lower compression part 73 may include a second lower heater (not shown). The second lower heater may be substantially same as, or similar to the first lower heater 71*t*. The heat generated by the second lower heater may be emitted to outside the second lower compression part 73, by a second lower compression surface 73*s* (e.g., second heatable surface). The first lower compression part 71 and the second lower compression part 73 may be spaced apart from each other in (or along) the second direction D2.

The first lower compression part 71 and the second lower compression part 73 may each be movable along the second direction D2, such as in a direction toward each other and in a direction away from each other. For this, an actuator, such as a slide structure and a motor, for guiding the movement of the first lower compression part 71 and the second lower compression part 73 may be provided. That is, a compression part (or force applicator) may further include the actuator, such as the slide structure and the motor, for guiding the movement of the first lower compression part 71 and the second lower compression part 73. The first lower compression part 71 may move in the second direction D2, and the second lower compression part 73 may move in a direction opposite to the second direction D2, so that the first lower compression part 71 and the second lower compression part 73 may get closer to each other.

A shielding bag SB which is located between the first lower compression part 71 and the second lower compression part 73 may be heat-compressed by force applied by the two bars (e.g., the first lower compression part 71 and the second lower compression part 73) which get closer to each other. More particularly, the shielding bag SB may be heated by the heat emitted from the first lower heater 71*t* and the second lower heater. In addition, the shielding bag SB may be pressed from a front side and a rear side, by force applied from the first lower compression surface 71*s* and the second lower compression surface 73*s*, respectively. In an embodiment, the shielding bag material from which the shielding bag SB is provided, may include a front-side portion and a rear-side portion as the two layers facing each other, and application of force and/or heat to the two layer of the shielding bag material may be bond the front-side and rear-side portions to each other at a bonded portion. Thereby, the front-side portion and the rear-side portion of the shielding bag material may be bonded to each other to form (or provide) a shielding bag SB having a shape such that central portions thereof are separated (e.g., unbonded to each other) to provide an inner space of the shielding bag SB.

Figure 5:
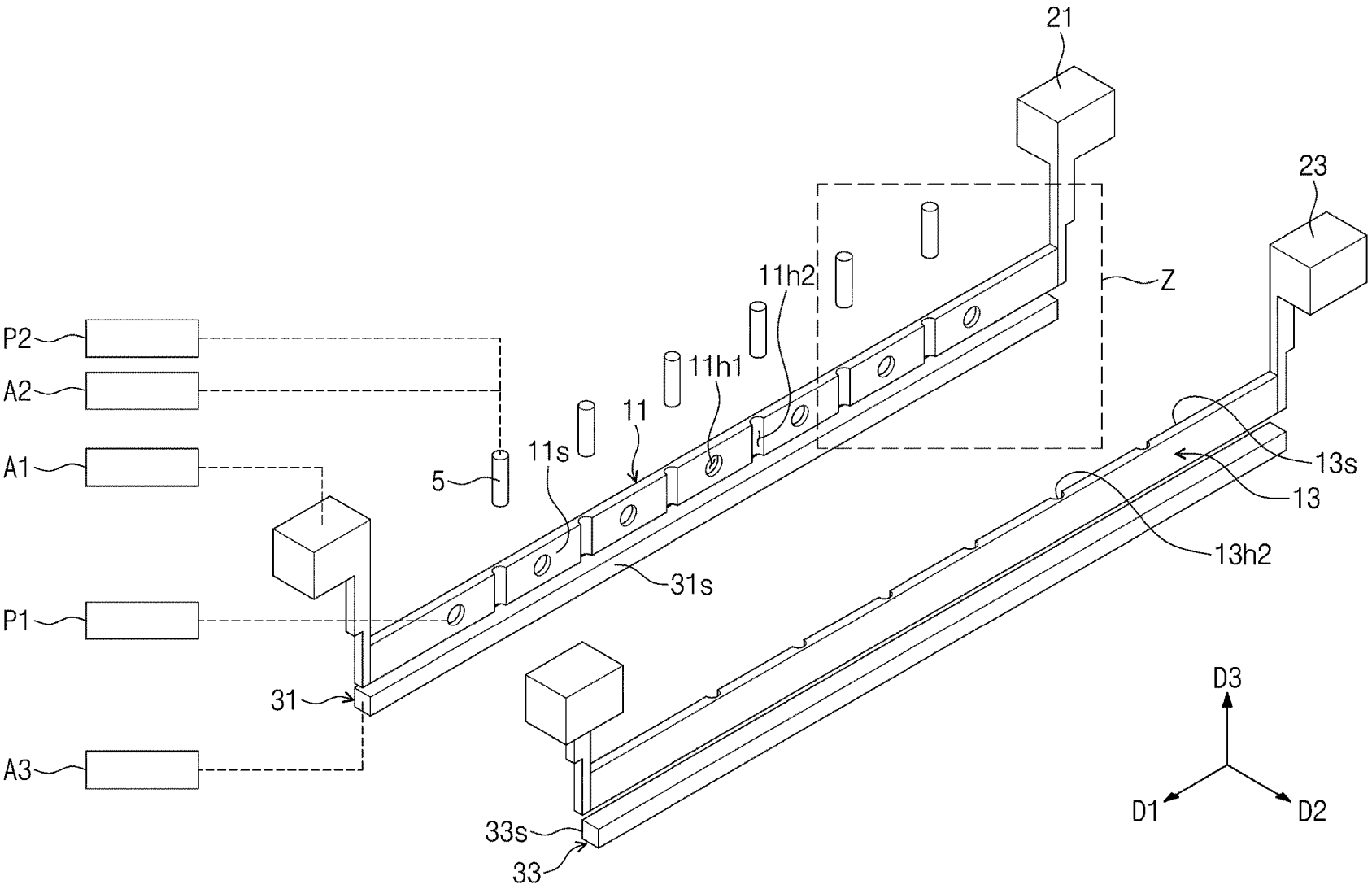
FIG. 5 is a perspective view illustrating a shielding bag gripping apparatus according to an embodiment.
Figure 6:
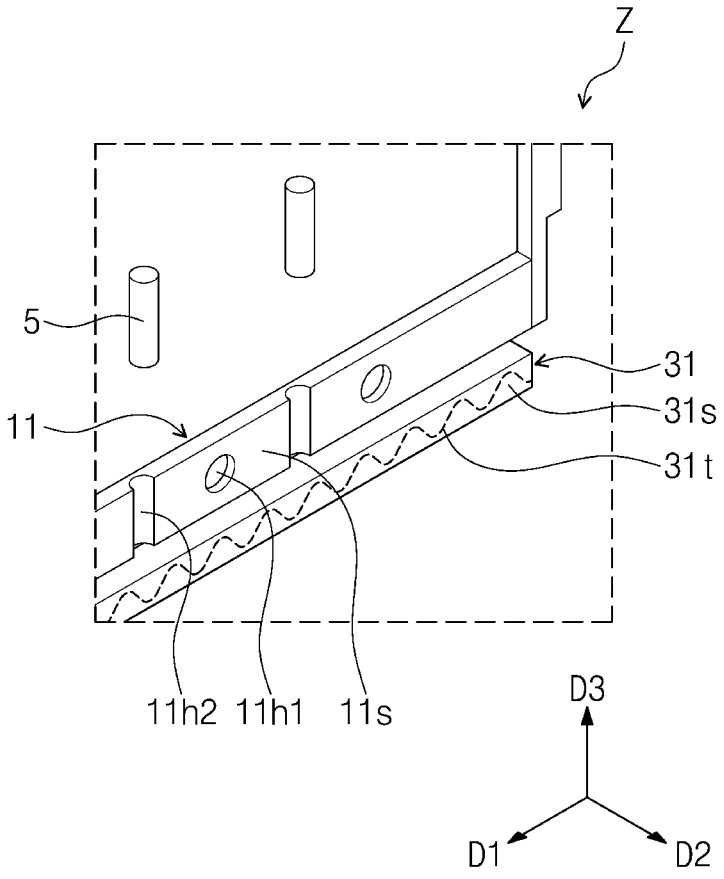
FIG. 6 is an enlarged perspective view of a part Z in FIG. 5.

FIG. 5 is a perspective view illustrating a shielding bag gripping apparatus G according to an embodiment, and FIG. 6 is an enlarged perspective view of a part Z in FIG. 5.

Referring to FIG. 5, the shielding bag gripping apparatus G may include a first suction part 11 (e.g., first suction bar), a second suction part 13 (e.g., second suction bar), a first connection part 21 (e.g., first connector), a second connection part 23 (e.g., second connector), a suction part driver A1, a suction pump P1, a first compression part 31 (e.g., third sealing bar), a second compression part 33 (e.g., fourth sealing bar), a compression part driver A3 (e.g., sealing bar driver), a nozzle 5, an air supply part P2, and a nozzle driver A2.

The first suction part 11 may be a member extending a length in the first direction D1. The first suction part 11 may face the second suction part 13. More particularly, the first suction part 11 and the second suction part 13 may be spaced apart from each other in the second direction D2. The first suction part 11 may be movable in the second direction D2. Accordingly, the distance between the first suction part 11 and the second suction part 13 may be changed. The first suction part 11 and the second suction part 13 may compress and/or suction a shielding bag SB respectively thereto, thereby fixing the shielding bag SB to the shielding bag gripping apparatus G at the first suction part 11 and/or the second suction part 13. The first suction part 11 may include a first suction surface 11*s*, a first suction hole 11*h*1, and a first placement hole 11*h*2 (e.g., first recess).

The first suction surface 11*s* may be disposed in a plane defined by directions crossing each other, to have a normal line relative to the plane which is parallel to the second direction D2. That is, the first suction surface 11*s* may be oriented toward the second suction part 13.

The first suction hole 11*h*1 may be exposed to outside the first suction part 11, by (or at) the first suction surface 11*s*. The first suction hole 11*h*1 may be open in a direction toward the second suction part 13. The first suction hole 11*h*1 may be connected to an air path (not shown) formed in the first suction part 11. The first suction hole 11*h*1 may be connected to the suction pump P1. More particularly, the first suction hole 11*h*1 may be connected to the suction pump P1 through the air path formed in the first suction part 11. Accordingly, negative pressure provided by the suction pump P1 may be delivered to the first suction hole 11*h*1. By the negative pressure delivered to the first suction hole 11*h*1, a force is applied toward the first suction part 11 and one surface of a shielding bag SB (e.g., front-side portion of a shielding bag material) disposed between the first suction part 11 and the second suction part 13 may be suctioned to the first suction surface 11*s*. The first suction hole 11*h*1 may be provided in plurality. The plurality of first suction holes 11*h*1 may be disposed apart from each other along the first suction part 11, in the first direction D1. However, hereinafter, the first suction hole 11*h*1 will be described as being single, for convenience.

The first placement hole 11*h*2 may vertically extend (e.g., in the third direction D3). The first placement hole 11*h*2 may be a nozzle recess in a body of the first suction part 11, and the recess is open toward the second suction part 13. More particularly, the first placement hole 11*h*2 may extend in the third direction D3, to be open at both upper and lower surfaces of the body of the first suction part 11, thereby penetrating the first suction part 11 at the upper and lower surfaces. In embodiments, the first placement hole 11*h*2 may be exposed to outside the first suction surface 11*s*. The nozzle 5 may be selectively inserted into the first placement hole 11*h*2. The first placement hole 11*h*2 may be provided in plurality. The plurality of first placement holes 11*h*2 may be disposed spaced apart from each other in the first direction D1. However, hereinafter, the first placement hole 11*h*2 will be described as being single, for convenience.

Descriptions above for the first suction part 11 may be similarly applied to respective components of the second suction part 13. The second suction part 13 may be a member extending a length in the first direction D1. The second suction part 13 may face the first suction part 11. More particularly, the second suction part 13 may be spaced apart from the first suction part 11 in the second direction D2. The second suction part 13 may be movable in the second direction D2. The second suction part 13 may include a second suction surface 13*s*, a second suction hole (not shown), and a second placement hole 13*h*2 (e.g., second recess).

The second suction surface 13*s* may have a normal line parallel to the second direction D2. That is, the second suction surface 13*s* may be oriented toward the first suction part 11. Accordingly, the second suction surface 13*s* may face the first suction surface 11*s*.

The second suction hole may be exposed outside the second suction surface 13*s*. The second suction hole may be connected to an air path (not shown) formed in the second suction part 13. The second suction hole may be connected to the suction pump PT. More particularly, the second suction hole may be connected to the suction pump P1 through the air path formed in the second suction part 13. Accordingly, negative pressure provided by the suction pump P1 may be delivered to the second suction hole. By the negative pressure delivered to the second suction hole, the other surface of the shielding bag SB (e.g., rear-side portion of a shielding bag material) disposed between the first suction part 11 and the second suction part 13 may be suctioned to the second suction surface 13*s*. The second suction hole may be provided in plurality. The plurality of second suction holes may be disposed apart from each other in the first direction D1. However, hereinafter, the second suction hole will be described as being single, for convenience.

The second placement hole 13*h*2 may vertically extend. More particularly, the second placement hole 13*h*2 may extend in the third direction D3, and penetrate the second suction part 13. In embodiments, the second placement hole 13*h*2 may be exposed to outside the second suction surface 13*s*. When the first suction part 11 and the second suction part 13 get closer to each other, the second placement hole 13*h*2 and the first placement hole 11*h*2 may be aligned with each other and connected to each other. That is, a position of the second placement hole 13*h*2 may correspond to a position of the first placement hole 11*h*2. The nozzle 5 may be selectively inserted into the second placement hole 13*h*2. The second placement hole 13*h*2 may be provided in plurality. The plurality of second placement holes 13*h*2 may be disposed spaced apart from each other in the first direction D1. However, hereinafter, the second placement hole 13*h*2 will be described as being single, for convenience.

The first connection part 21 may be coupled to the first suction part 11. The first connection part 21 may connect the first suction part 11 and the suction part driver A1 to each other. The number of first connection parts 21 may be two as illustrated in FIG. 5, but is not limited thereto.

The second connection part 23 may be coupled to the second suction part 13. The second connection part 23 may connect the second suction part 13 and the suction part driver A1 to each other. The number of second connection parts 23 may be two as illustrated in FIG. 5, but is not limited thereto.

The suction part driver A1 may operate or be controlled to move the first suction part 11 and the second suction part 13 which are connected to the suction part driver A1. In an embodiment, for example, the suction part driver A1 may move the first suction part 11 in the second direction D2, and move the second suction part 13 in a direction opposite to the second direction D2, so that the first suction part 11 and the second suction part 13 get closer to each other. In addition, the first suction part 11 and the second suction part 13 may get farther away from each other. Alternatively, the suction part driver A1 may cause the first suction part 11 and the second suction part 13 to move in parallel vertically and/or horizontally, while maintaining the distance between the first suction part 11 and the second suction part 13 a fixed distance. That is, the suction part driver A1 may be operated or controlled to cause the first suction part 11 and the second suction part 13 to move together with each other, while maintaining the distance therebetween along the second direction D2. For this, the suction part driver A1 may include an actuator (e.g., an electric motor and a hydraulic motor), a control part, a battery, etc.

One or more of the suction pump P1 may be connected to the first suction hole 11*h*1 and the second suction hole. The suction pump P1 may provide negative pressure to each of the first suction hole 11*h*1 and the second suction hole. For this, the suction pump P1 may include a compressor, or the like, capable of providing negative pressure.

Referring to FIGS. 5 and 6, the first compression part 31 may extend a length in the first direction D1. The first compression part 31 may be located below the first suction part 11. Along the third direction D3, the first compression part 31 may be closer to the shielding bag feeder F than the first suction part 11. The first compression part 31 and the second compression part 33 may be spaced apart from each other in the second direction D2. The first compression part 31 may be movable in the second direction D2. The first compression part 31 may include a first compression surface 31*s* and a first heater 31*t*. The first compression surface 31*s* may have a normal line parallel to the second direction D2. That is, the first compression surface 31*s* may be oriented toward the second compression part 33. The first heater 31*t* may mean a component that emits heat to the surroundings. In an embodiment, for example, the first heater 31*t* may mean a resistance line that emits Joule heat, when current flows therethrough, but is not limited thereto. The first heater 31*t* may mean another component capable of emitting heat to the surroundings. The heat generated by the first heater 31*t* may be emitted to outside the first compression part 31 by the first compression surface 31*s*.

Descriptions above for the first compression part 31 may be similarly applied to respective components of the second compression part 33. The second compression part 33 may extend a length in the first direction D1. The second compression part 33 may be located below the second suction part 13. The second compression part 33 may be spaced apart from the first compression part 31 in the second direction D2. The second compression part 33 may be movable in the second direction D2. The second compression part 33 may include the second compression surface 33*s* and a second heater (not shown). The second compression surface 33*s* may have a normal line parallel to the second direction D2. That is, the second compression surface 33*s* may face the first compression surface 31*s*. The second heater may be substantially same as, or similar to the first heater 31*t*.

The compression part driver A3 may be connected to the first compression part 31 and the second compression part 33 (e.g., sealing part), and may be operated or controlled to move the first compression part 31 and the second compression part 33. In an embodiment, for example, the compression part driver A3 may variously move the first compression part 31 and the second compression part 33 in the second direction D2 and in a direction opposite to the second direction D2, so that the first compression part 31 and the second compression part 33 get closer to or farther away from each other. Alternatively, the compression part driver A3 may cause the first compression part 31 and the second compression part 33 to move in parallel vertically and/or horizontally, while maintaining the distance between the first compression part 31 and the second compression part 33 a fixed distance. Similarly to that descried above for the suction part driver A1, the compression part driver A3 may be operated or controlled to cause the first compression part 31 and the second compression part 33 to move together with each other, while maintaining the distance therebetween along the second direction D2. For this, the compression part driver A3 may include an actuator (e.g., an electric motor and a hydraulic motor), a control part, a battery, etc.

The nozzle 5 may be selectively insertable into the first placement hole 11*h*2 and/or the second placement hole 13*h*2. A dimension, shape, etc. of the nozzle 5 may correspond to that of the first placement hole 11*h*2 and/or the second placement hole 13*h*2, such that the nozzle 5 is engageable with one or more of the respective placement holes.

The nozzle 5 may be vertically movable. In an embodiment, for example, the nozzle 5, which is positioned outside of and/or above the first suction part 11, may descend and be inserted into the first placement hole 11*h*2. The air supply part P2 may supply the nozzle 5 with positive pressure or negative pressure. Accordingly, the nozzle 5 may blow air to a region below the nozzle 5, or suction air from a region below the nozzle 5. The nozzle 5 may be provided in plurality. In an embodiment, for example, the number of nozzles 5 provided herein may correspond to the number of the first placement holes 11*h*2. The plurality of nozzles 5 may be spaced apart from each other in the first direction D1. However, hereinafter, the nozzle 5 will be described as being single, for convenience.

The air supply part P2 may be connected to the nozzle 5. The air supply part P2 may provide the nozzle 5 with positive pressure or negative pressure. For this, the air supply part P2 may include a compressor, etc.

The nozzle driver A2 may be connected to the nozzle 5. The nozzle driver A2 may operate or be controlled to move the nozzle 5. In an embodiment, for example, the nozzle driver A2 may vertically move the nozzle 5, thereby inserting the nozzle 5 into the first placement hole 11*h*2 and/or out of the respective placement hole. For this, the nozzle driver A2 may include an actuator (e.g., an electric motor and a hydraulic motor), a control part, a battery, etc.

Figure 7:
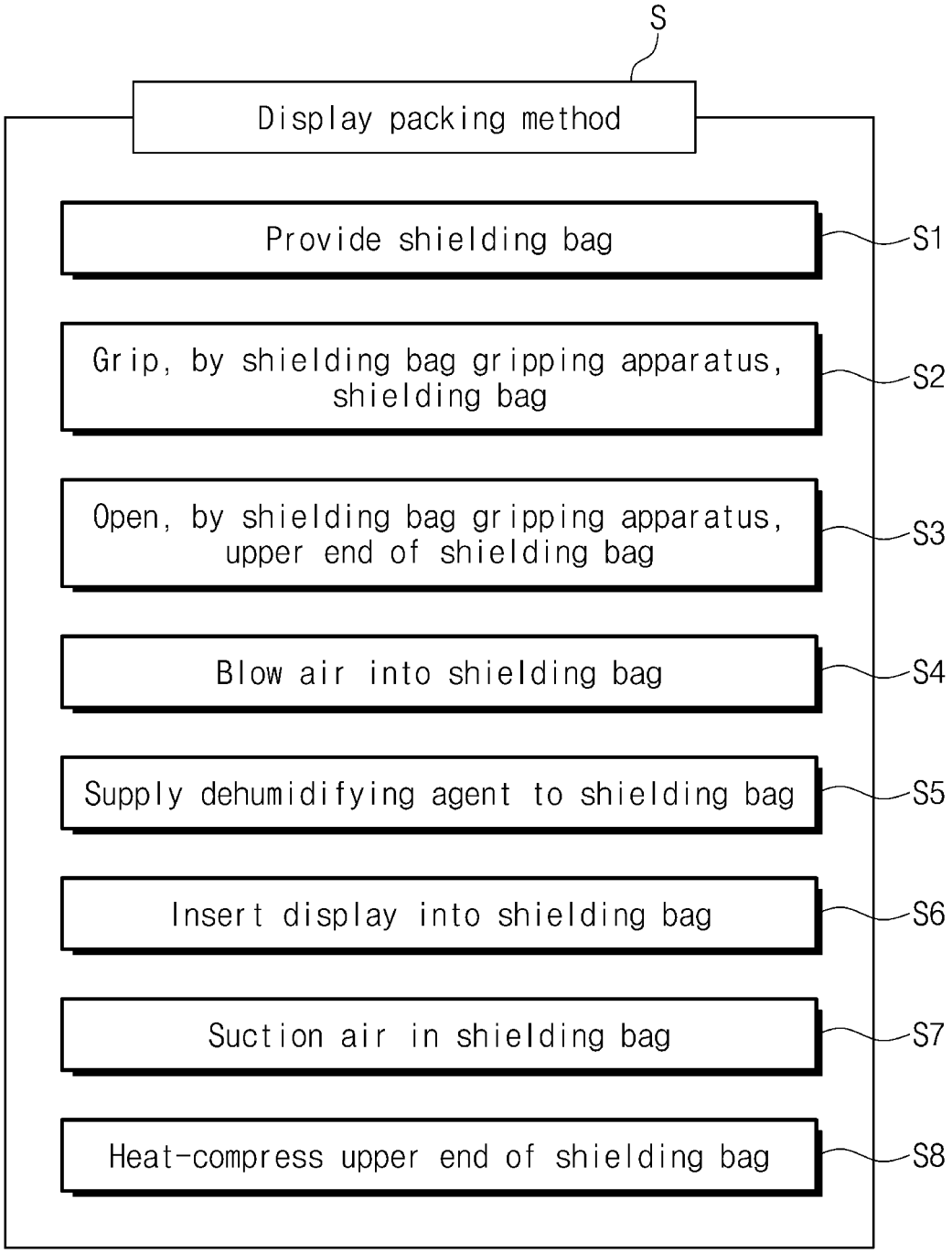
FIG. 7 is a flowchart illustrating a display packing method according to an embodiment.

FIG. 7 is a flowchart illustrating a display packing method S according to an embodiment.

Referring to FIG. 7, a display packing method S may be provided. The display packing method S may mean a method for packing a display D within a shielding bag SB by using a display packing system K described with reference to FIG. 1. The display packing method S may include an operation (S1) of supplying a shielding bag SB, an operation (S2) of gripping, by a shielding bag gripping apparatus G, the shielding bag, an operation (S3) of opening, by the shielding bag gripping apparatus G, upper ends of the shielding bag SB, an operation (S4) of blowing air into the shielding bag SB, an operation (S5) of supplying a dehumidfying agent to the shielding bag SB, an operation (S6) of inserting a display D into the shielding bag SB, an operation (S7) of suctioning air in the shielding bag SB, and an operation (S8) of heat-compressing the upper ends of the shielding bag SB.

Hereinafter, operations of a display packing method S in FIG. 7 will be described in detail with reference to FIGS. 8 to 17.

FIGS. 8 to 17 are perspective views sequentially illustrating a display packing method S according to the flowchart in FIG. 7.

Figure 8:
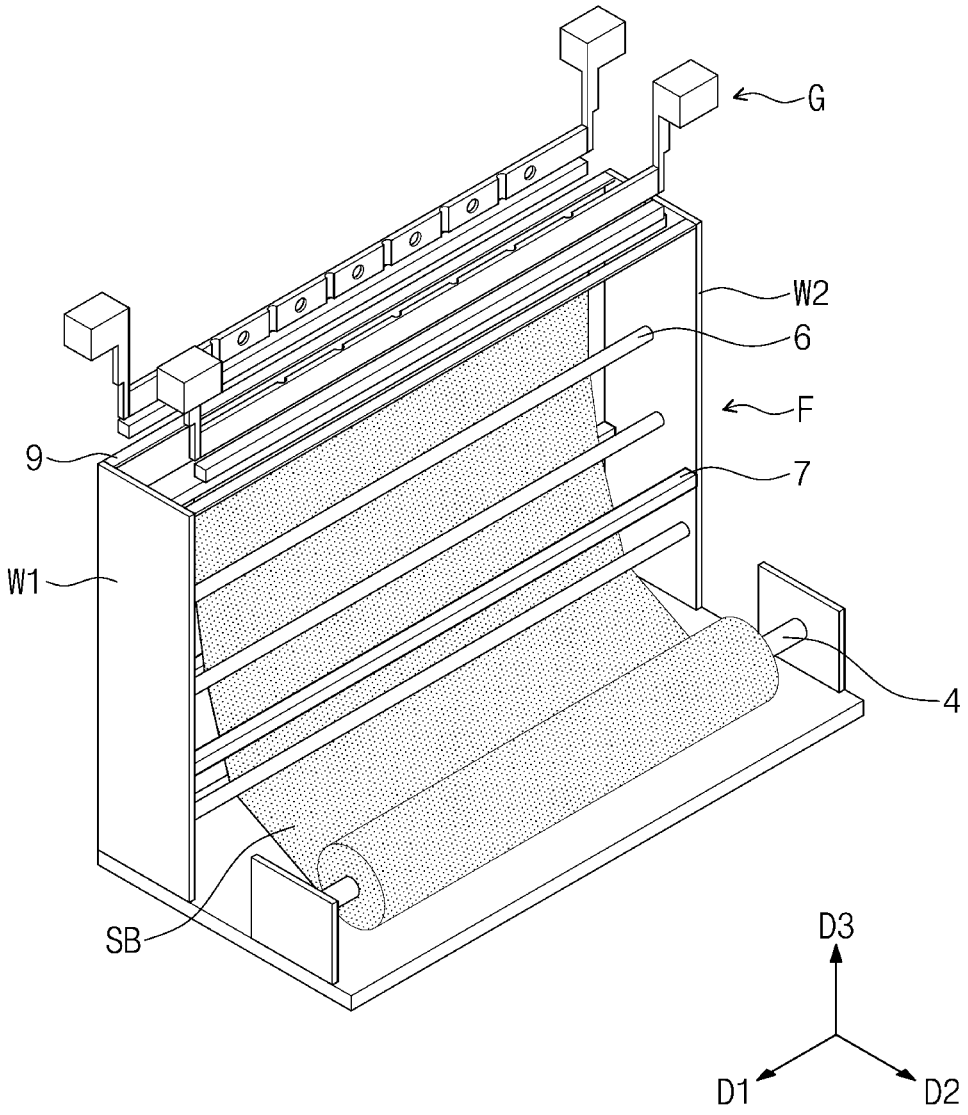
FIGS. 8 to 17 are perspective views sequentially illustrating a display packing method according to the flowchart in FIG. 7.

Referring to FIGS. 8 and 7, the operation (S1) of supplying the shielding bag SB may include supplying, by a shielding bag feeder F, the shielding bag SB as shielding bag material. More particularly, as a supply roller 4 rotates, the shielding bag SB rolled around the supply roller 4 may move upwards along a feeding direction, by a conveying roller 6. The shielding bag SB may move upwards while passing through between lower compression parts 7 which face each other. The shielding bag gripping apparatus G may be disposed on the shielding bag feeder F.

Figure 9:
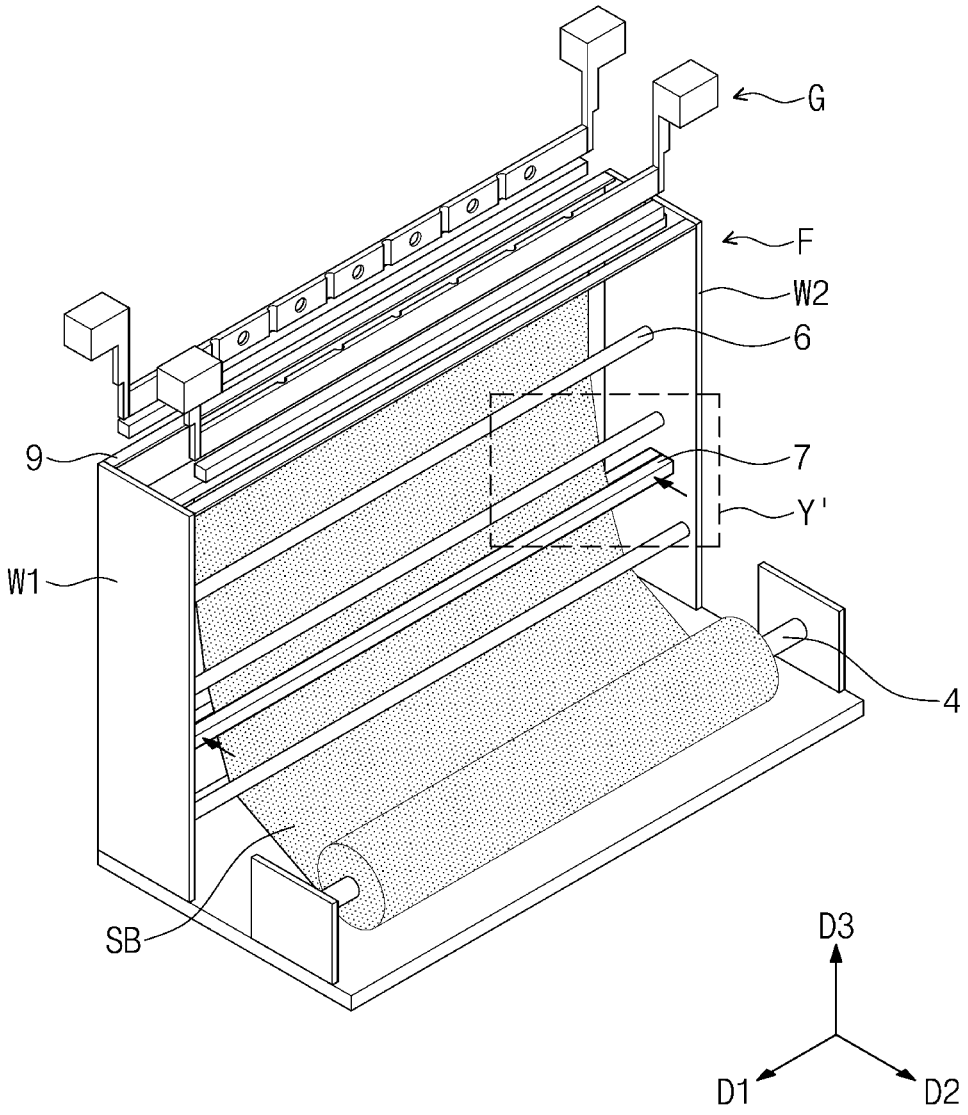
Figure 10:
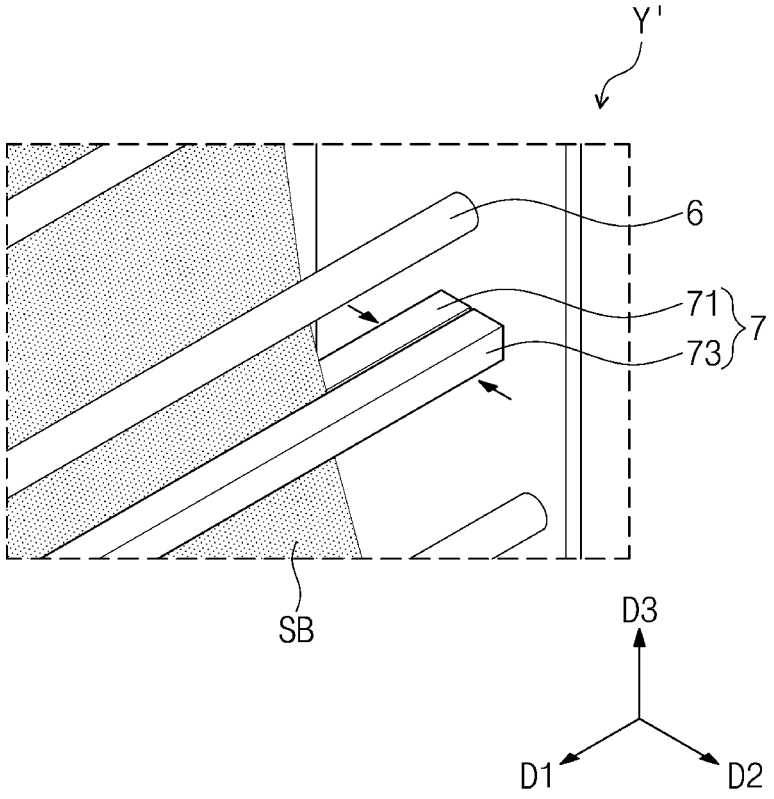

Referring to FIGS. 9 and 10, the operation (S1) of supplying a shielding bag SB may further include an operation of heat-compressing, by the lower compression part 7, lower ends of the shielding bag SB. A length of a final shielding bag may correspond to a length of the shielding bag material. The length of the shielding bag material may define the lower end and upper end of the final shielding bag. More particularly, front and rear portions of the shielding bag SB which face each other along the second direction D2 and are both located between a first lower compression part 71 and a second lower compression part 73 may be bonded to each other, by the shielding bag material being pressed from a front side and a rear side thereof in a state of being heated by the lower compression part 7. Accordingly, a front side portion and a rear side portion of the shielding bag SB which face each other along the second direction D2, may be bonded to each other to define a bonded part or a first seal of the shielding bag SB, where a preliminary shielding bag includes a first seal at one end thereof and an open end at an opposite end to the one end.

An inner space of the shielding bag SB may be defined between the lower end and the upper end of the final shielding bag. The front layer and the rear layer of the shielding bag material may be un-bonded at the inner space. The inner space of the shielding bag SB may be separated vertically with reference to a bonded part.

Figure 11:
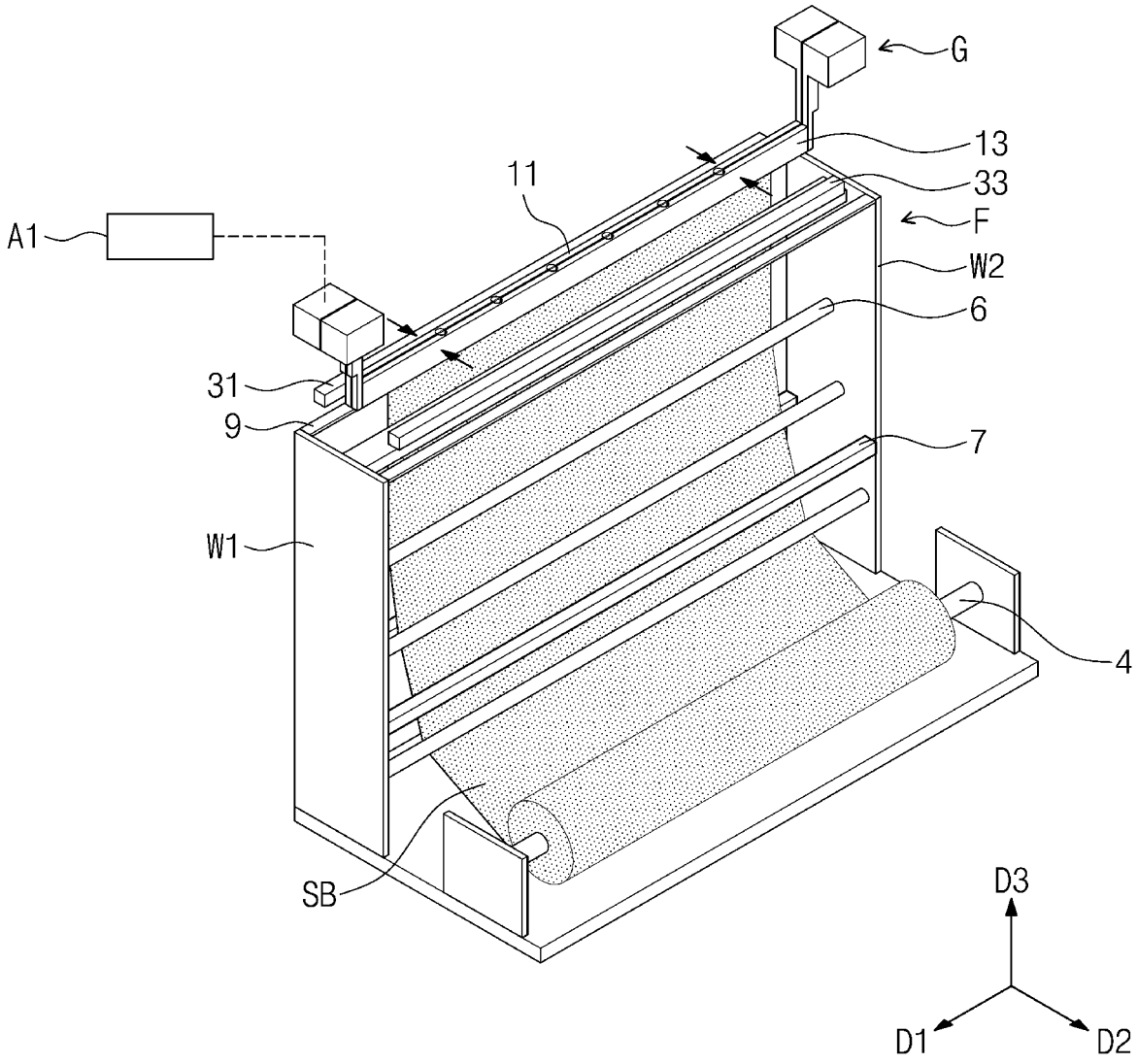

Referring to FIGS. 10 and 11, the first lower compression part 71 and the second lower compression part 73 may move away from each other, such as to release the shielding bag material. The first seal of the shielding bag material may move together with a remainder of the material along the feeding direction. The upper ends of the two layers of the shielding bag material may move along the feeding direction to be accessible by the shielding bag gripping apparatus G.

Referring to FIGS. 11 and 7, the operation (S2) of gripping, by the shielding bag gripping apparatus G, the shielding bag SB may include gripping, by the shielding bag gripping apparatus G, a portion of the shielding bag material corresponding to upper ends of the layers of the shielding bag SB, where the upper ends are accessible by the shielding bag gripping apparatus G. More particularly, a first suction part 11 and a second suction part 13 may get closer to each other, by operation of a suction part driver A1, and press the shielding bag SB located between the first suction part 11 and the second suction part 13, thereby fixing the shielding bag SB to the shielding bag gripping apparatus G. A time for the operation (S2) of gripping, by the shielding bag gripping apparatus G, the shielding bag SB may partially overlap a time for the operation (S1) of supplying the shielding bag SB (e.g., be simultaneous).

Figure 12:
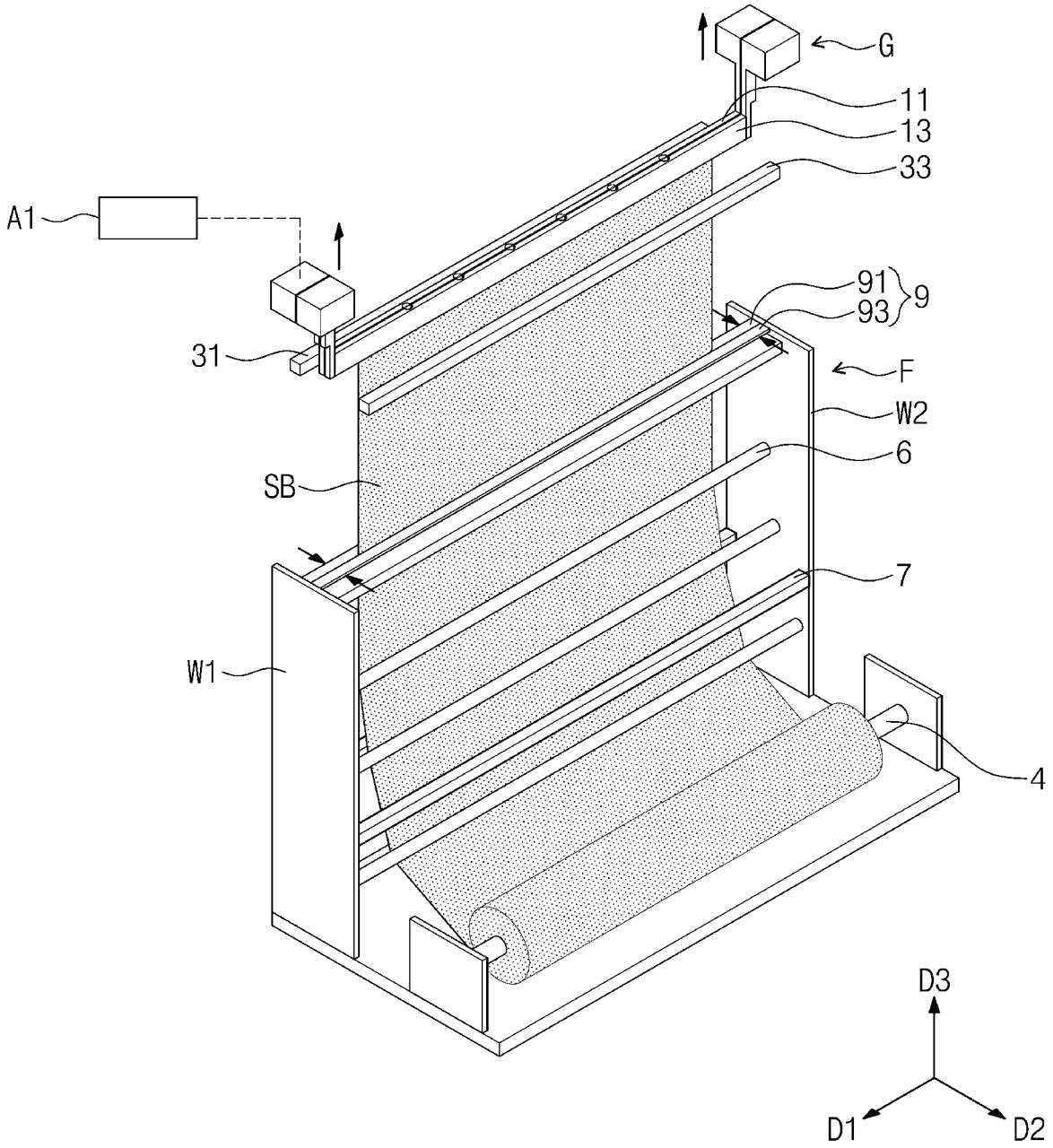

Referring to FIG. 12, the operation (S1) of supplying the shielding bag SB may further include an operation of cutting, by a cutting part 9, the shielding bag SB. The operation of cutting, by a cutting part 9, the shielding bag SB may be performed while the shielding bag gripping apparatus G is gripping the shielding bag SB. That is, as described above, a time for the operation (S1) of supplying a shielding bag SB may partially overlap a time for the operation of gripping, by a shielding bag gripping apparatus G, the shielding bag SB. The operation of cutting, by the cutting part 9, the shielding bag SB may be performed in a state in which the shielding bag gripping apparatus G moves a distance upwards and in a direction away from the shielding bag feeder F, while gripping the shielding bag SB. In the operation of cutting, by the cutting part 9, the shielding bag SB, a first cutting blade 91 and a second cutting blade 93 may get closer to each other, thereby cutting the shielding bag SB disposed between the first cutting blade 91 and the second cutting blade 93 at a cut part of the shielding bag material. The cut part of the shielding bag SB may correspond to a lower end of a final shielding bag and be located lower than the bonded part which is bonded by the lower compression part 7 (e.g., closer to the supply roller 4).

By cutting of the shielding bag material, the shielding bag gripping apparatus G may remain gripping a preliminary shielding bag which is separated from a reminder of the roll of shielding bag material. The preliminary shielding bag may include a length of the shielding bag material having an upper end at the shielding bag gripping apparatus G and a lower end furthest from the shielding bag gripping apparatus G. The preliminary shielding bag may be moveable together with the shielding bag gripping apparatus G, such as away from the shielding bag feeder F and toward another station of the display packing system K (see, FIG. 1).

Figure 13:
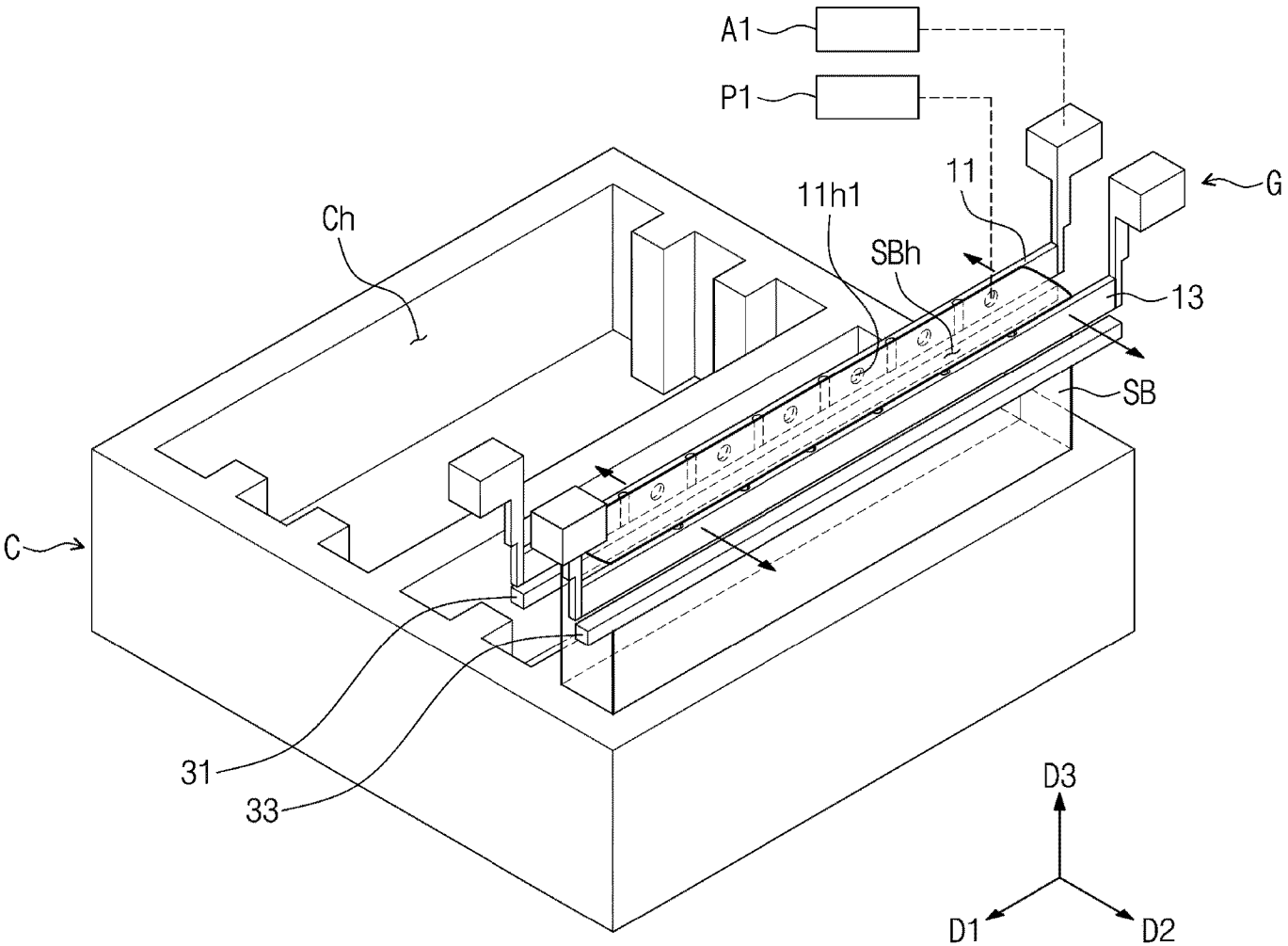

Referring to FIGS. 13 and 7, the shielding bag gripping apparatus G gripping the shielding bag SB may move to above a case housing C. The operation (S3) of opening, by the shielding bag gripping apparatus G, the upper end of the shielding bag SB may include opening, by the shielding bag gripping apparatus G, the upper end of the shielding bag SB toward a front side and a rear side, respectively. Opening of the preliminary shielding bag may include spacing the two layers of the ring-shaped material apart from each other, along the second direction D2. The operation (S3) of opening, by the shielding bag gripping apparatus G, the upper end of the shielding bag SB may be performed above the case housing C as illustrated in FIG. 13. In an embodiment, for example, in a state in which a part of the gripped shielding bag SB is inserted into an insertion space Ch of the case housing C, the shielding bag gripping apparatus G may open the upper ends of the shielding bag SB. However, the invention is not limited thereto, and the shielding bag gripping apparatus G may open the upper ends of the shielding bag SB at another position relating to the case house C and/or another location along the display packing system K.

In the operation (S3) of opening, by the shielding bag gripping apparatus G, the upper ends of the two layers of the ring-shaped material the shielding bag SB, the first suction part 11 and the second suction part 13 may get farther away from each other. More particularly, in a state in which one surface (e.g., first layer) of the shielding bag SB is suctioned to the first suction part 11 due to negative pressure delivered from a suction pump P1 to a first suction hole 11*h*1, the first suction part 11 may move to a direction opposite to the second direction D2 by the suction part driver A1. In addition, in a state in which the other surface (e.g., second layer) of the shielding bag SB is suctioned to the second suction part 13 due to negative pressure delivered from the suction pump P1 to a second suction hole (not shown), the second suction part 13 may move to the second direction D2 by the suction part driver A1. Accordingly, the upper end of the shielding bag SB may be opened by respectively moving the two layers of the ring-shaped material toward a front side and a rear side of the shielding bag material. The inner space SBh of the shielding bag SB may be exposed to the outside at an upper end of the shielding bag SB. In an embodiment, the facing layers of the ring-shaped shielding bag material may be suctioned to inner surfaces of the suction parts, at both suction surfaces and surfaces of the placement holes.

Figure 14:
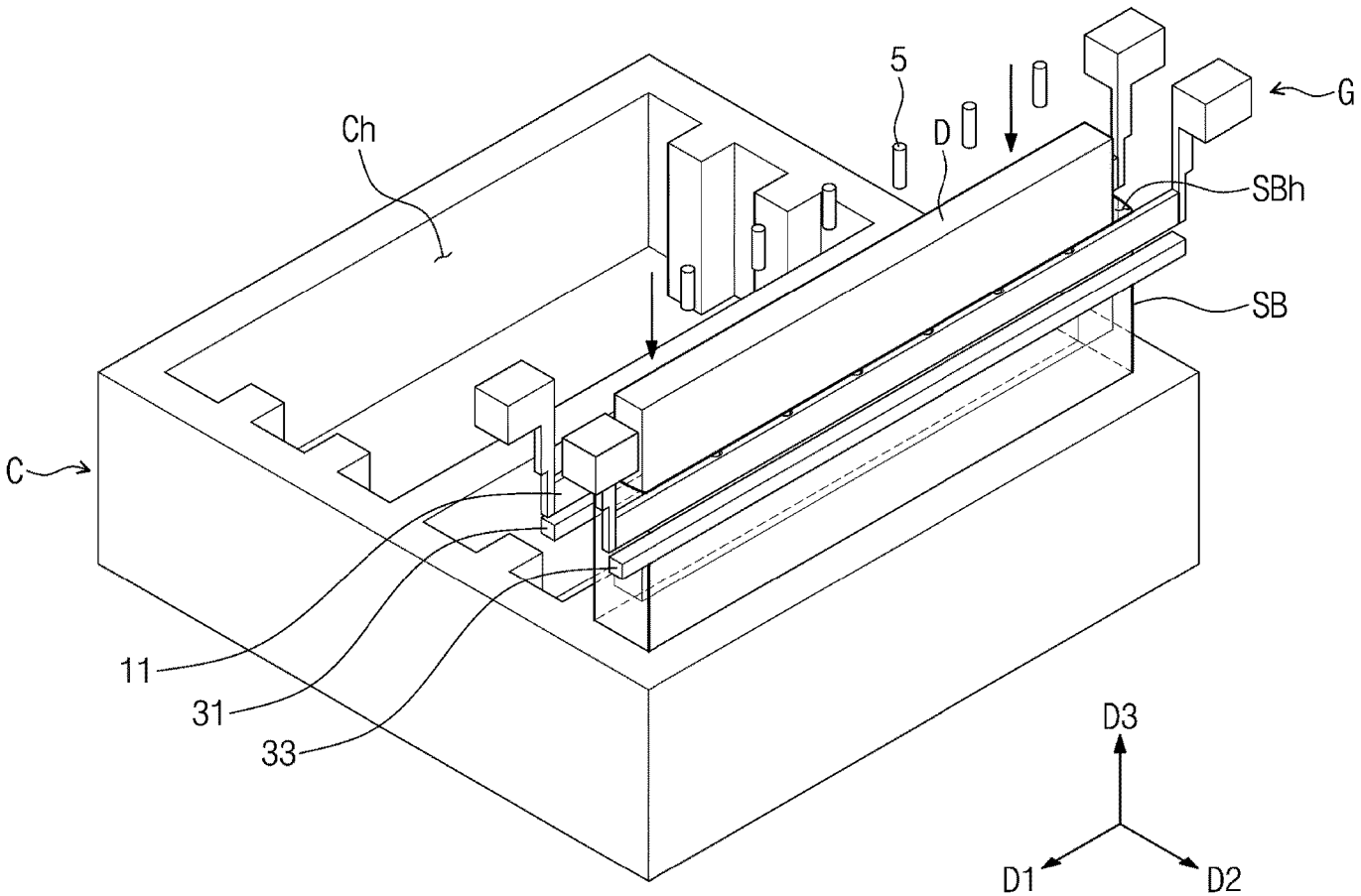

Referring to FIGS. 14 and 7, in the operation (S4) of blowing air into the shielding bag SB, air may be blown toward the inner space SBh of the shielding bag SB by a nozzle 5. Thus, the inner space of the shielding bag SB may be maintained to have a volume which is open to outside the shielding bag SB. The volume may be an initial volume of the shielding bag SB into which the display D is disposed. The nozzle 5 may be moved to the shielding bag SB under operation or control of the previously described nozzle driver A2 and air supply part P2.

The operation (S5) of supplying a dehumidfying agent to the shielding bag SB may include inserting a dehumidifying agent (not shown) into the shielding bag SB with the open upper end through the open upper end. More particularly, a dehumidifying agent supply part DHS (see FIG. 1) may supply the dehumidifying agent to the inner space SBh of the shielding bag SB, via the open upper end of the shielding bag SB. The lower end of the shielding bag SB may be closed (e.g., sealed) by the bonded part or the first seal of the shielding bag SB described above. Although not shown in detail, the dehumidifying agent supply part DHS may be moved to the shielding bag SB under operation or control of a dehumidifying agent supply part driver and the like.

The operation (S6) of inserting a display D into the shielding bag SB may include moving a display D down and inserting the display D into the shielding bag SB, via the open upper end thereof. The display D may be conveyed by a robot arm MR described with reference to FIG. 1, from another location or station away from the case housing C, and be inserted into the shielding bag SB at the case house C.

Figure 15:
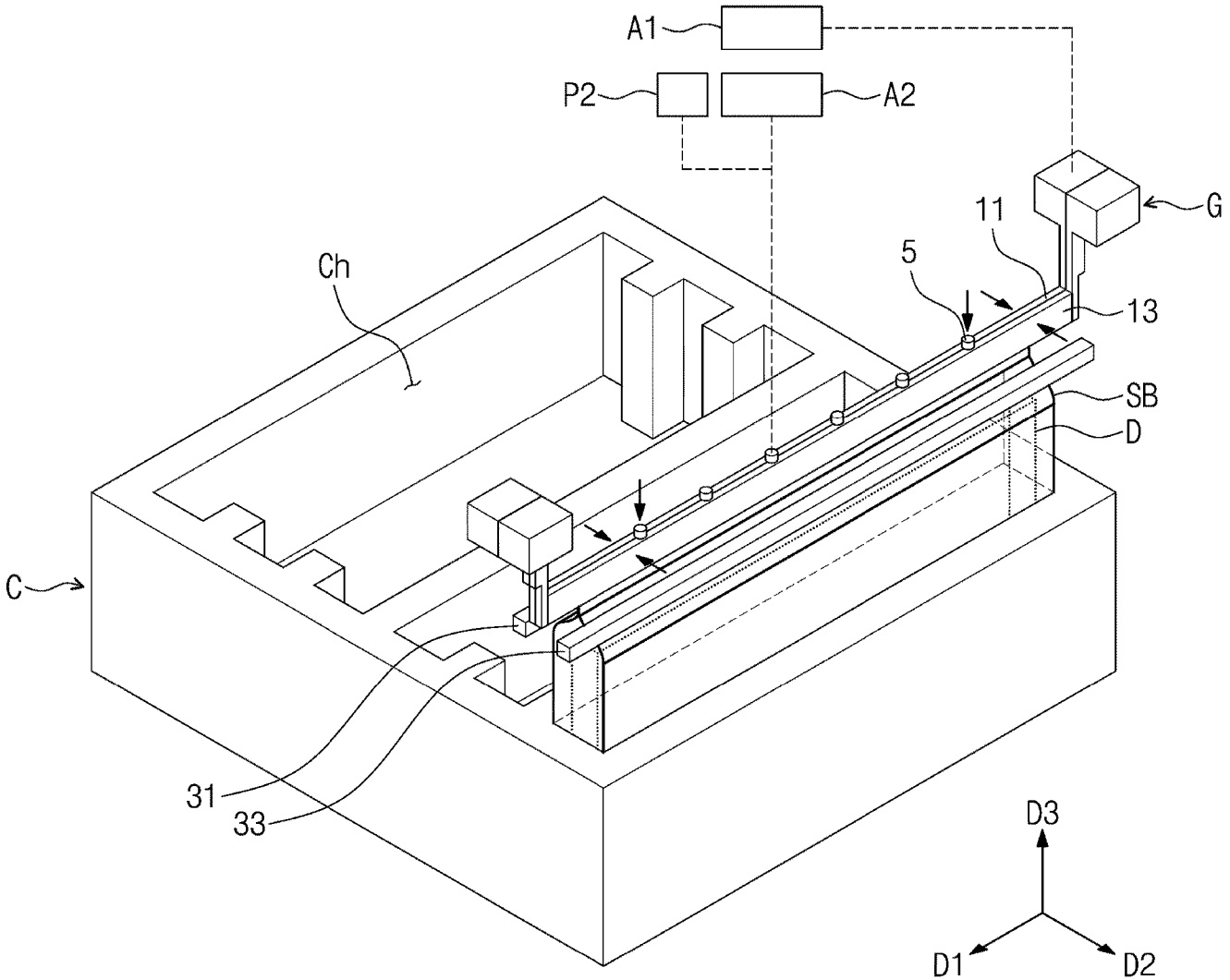

Referring to FIGS. 15 and 7, the operation (S7) of suctioning air out of the shielding bag SB may include suctioning, by the nozzle 5, air from the inside of the shielding bag SB having one sealed end. In an embodiment, for example, in a state in which the display D is completely inserted into the shielding bag SB, the first suction part 11 and the second suction part 13 may get closer to each other by the suction part driver A1, thereby separating the inner space of the shielding bag SB from the outside thereof. In an embodiment, the facing layers of the ring-shaped shielding bag material which extend along the inner surfaces of the suction parts, at both suction surfaces and surfaces of the placement holes, may form a gap between the facing layers corresponding to aligned placement holes of the suction parts. While the inner space of the shielding bag SB is generally separated from the outside thereof by the first suction part 11 and the second suction part 13 at a minimum distance from each other, the gap between the facing layers corresponding to aligned placement holes of the suction parts may provide access to the inner space of the shielding bag SB from outside thereof, without being limited thereto.

In this case, the nozzle 5 may penetrate the first suction part 11 via a first placement hole 11*h*2 (see FIG. 5), and be connected to the inner space of the shielding bag SB. In this state, the nozzle 5 that receives negative pressure by an air supply part P2 may suction air out of the inner space of the shielding bag SB. In an embodiment, for example, the first suction part 11 which is moved along the second direction D2 and toward the second suction part 13, disposes the shielding bag SB open at a location corresponding to the first recess (e.g., first placement hole 11*h*2) of the first suction part 11, to expose an inner space of the shielding bag SB to outside thereof, and the air nozzle which is moved into the first recess of the first suction part 11 disposes the air nozzle in communication with the inner space of the shielding bag SB and provides the negative pressure to remove air from the inner space of the shielding bag SB. Accordingly, the volume of the shielding bag SB having one sealed end and having the display D therein, may decrease. The shielding bag SB wrapping the display D may be shrunk to a size with which packing, storing, and transporting of the display D are easy. That is, the original volume of the shielding bag SB with the display D therein, may be reduced to a minimum volume.

Figure 16:
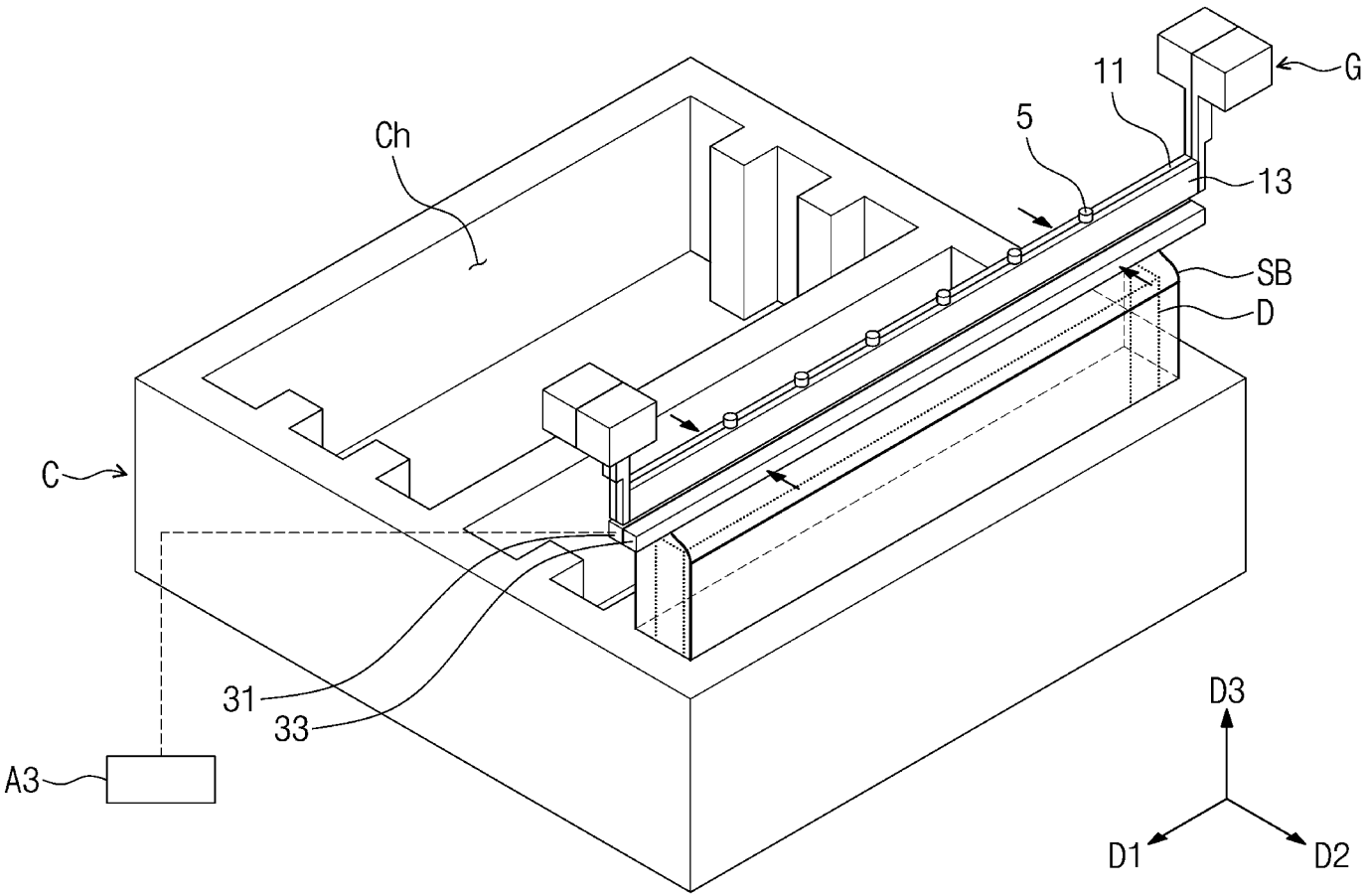

Referring to FIGS. 16 and 7, the operation (S8) of heat-compressing the unbonded upper ends of the shielding bag SB may include sealing the upper ends of the shielding bag SB by the first compression part 31 and the second compression part 33. More particularly, the first compression part 31 and the second compression part 33 may get closer to each other by a compression part driver A3, thereby pressing the shielding bag SB located between the first compression part 31 and the second compression part 33 from a front side and a rear side thereof. In addition, the two layers of the shielding bag SB may be heated by a first heater 31*t* (see FIG. 6). Accordingly, the shielding bag SB which may include vinyl, may be bonded or sealed at the upper end thereof, by heat-compressing the front surface and the rear surface thereof. Therefore, the inner space of the shielding bag SB may be separated from the outside. The heat-bonding of the layers of the shielding bag material at the upper end of the shielding bag SB may define a second seal. A final shielding bag may include the first seal and the second seal at opposing ends of the shielding bag SB, to define a sealed shielding bag having a target object (e.g., the display D) sealed therein.

Figure 17:
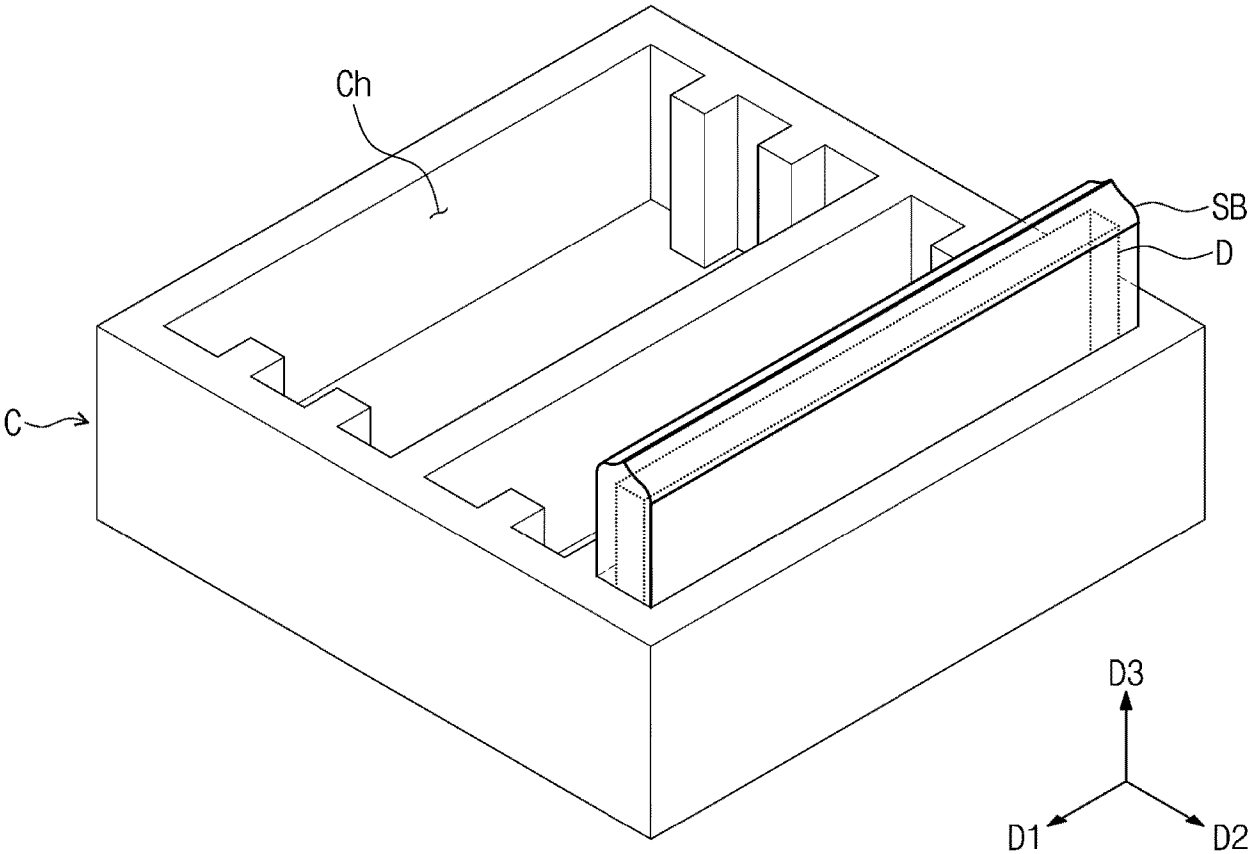

Referring to FIG. 17, the shielding bag gripping apparatus G (see FIG. 16) may be separated from the shielding bag SB which is sealed having the target object therein. More particularly, after heat-compression of the upper end of the shielding bag SB is finished, the shielding bag gripping apparatus G may move away from the shielding bag SB which is sealed, while the shielding bag SB and the display D are inserted into the case housing C. Thereafter, the same operation is repeated, and a plurality of displays D respectively sealed inside a plurality of shielding bags SB may be inserted into the case housing C. After the plurality of displays D are inserted into a single one of the case housing C, a cap (not shown) may be coupled to the case housing C. That is, the cap may cover the case housing C. The plurality of displays D in a single case housing which is capped, may be stored, transported, etc., while the plurality of displays D remain protected from damaged or contamination within the plurality of shielding bags SB.

According to one or more embodiment of a shielding bag gripping apparatus G, a display packing system K including the same, and a display packing method S using the same, a display D may be automatically packed in a sealed container. More particularly, a work of wrapping a display D with a shielding bag SB as the sealed container, may be automatically performed. Accordingly, inefficiency which may arise from a manual packing work may be reduced. For example, work time may be shortened, and accurate work may be made possible.

According to one or more embodiment of a shielding bag gripping apparatus G, a display packing system K including the same, and a display packing method S using the same, a volume of the shielding bag SB which is sealed may be reduced to a minimum, in a state in which a display D is within the shielding bag SB. More particularly, while a shielding bag SB is sealed, the volume of the sealed shielding bag may be reduced by suctioning air from the inner space of the shielding bag SB through a nozzle 5 penetrating a compression part. Accordingly, the shielding bag SB which wraps a display D may be reduced in volume to a minimum volume, which optimizes packing, storing, and transporting of the display D. The suction parts, the compression parts and the nozzles together with each other, may define a sealing apparatus which both reduces the volume and seals the protective container (e.g., sealing bag SB) having the display D therein, immediately after packing the display D within such protective container and at a same location (e.g., the case housing C) without moving the display D in the protective container.

According to one or more embodiment of a shielding bag gripping apparatus G, a display packing system K including the same, and a display packing method S using the same, a shielding bag SB which is unsealed and into which a display D is inserted, may be automatically sealed. Accordingly, damage or contamination of the display D during storage and transport of the display D, may be reduced or effectively prevented.

According to one or more embodiment of a shielding bag gripping apparatus G, a display packing system K including the same, and a display packing method S using the same, a display D may be automatically packed.

According to one or more embodiment of a shielding bag gripping apparatus G, a display packing system K including the same, and a display packing method S using the same, a shielding bag SB may be automatically sealed.

According to one or more embodiment of a shielding bag gripping apparatus G, a display packing system K including the same, and a display packing method S using the same, air may be blown into an unsealed shielding bag or air be removed from the inside of the unsealed shielding bag, immediately before sealing of the unsealed shielding bag. A same air nozzle may be used in providing of the air into the unsealed shielding bag, and for removal of the air from the unsealed shielding bag immediately before the sealing of the shielding bag SB.

In the above, description has been made with reference to embodiments of the invention, but those skilled in the art or those of ordinary skill in the relevant technical field may understand that various modifications and changes may be made to the invention within the scope not departing from the spirit and the technology scope of the invention described in the claims to be described later. Therefore, the technical scope of the invention is not limited to the contents described in the detailed description of the specification, but should be determined by the claims.

What is claimed is:

1. A shielding bag gripping apparatus for providing a shielding bag, comprising:

a first suction bar which extends along a first direction;

a second suction bar which extends along the first direction and is spaced apart from the first suction bar along a second direction crossing the first direction;

the first suction bar moveable along the second direction relative to the second suction bar;

a first sealing bar and a second sealing bar at a same side of the first and second suction bars, along a third direction crossing each of the first and second directions, the first sealing bar facing the second sealing bar along the second direction and movable along the second direction relative to the second sealing bar;

the first suction bar including:

a first suction hole which grips the shielding bag by suction, and a first recess which is adjacent to the first suction hole along the first direction, the first recess being open toward the second suction bar along the second direction together with being open toward the first sealing bar along the third direction;

the second suction bar including:

a second suction hole which grips the shielding bag by suction, and a second recess which is adjacent to the second suction hole along the first direction, the second recess corresponding to the first recess along the second direction, and being open toward the first suction bar along the second direction together with being open toward the second sealing bar along the third direction; and an air nozzle corresponding to the first recess of the first suction bar, and movable into and out of the first recess.

2. The shielding bag gripping apparatus of claim 1, further comprising:

a suction part driver which is connected to the first suction bar and moves the first suction bar along the second direction; and a suction pump which is connected to the first suction bar and the second suction bar, and supplies negative pressure to each of the first suction hole and the second suction hole, to provide the suction at the first suction hole and the second suction hole.

3. The shielding bag gripping apparatus of claim 1, further comprising a sealing bar driver which moves the first sealing bar along the second direction and toward the second sealing bar, wherein the first sealing bar includes a first heater.

4. The shielding bag gripping apparatus of claim 1, wherein the first suction bar which is moved to the second suction bar includes the first recess aligned with the second recess and defining an aligned placement hole open in opposing directions along the third direction.

5. The shielding bag gripping apparatus of claim 1, wherein the first suction bar further includes the first recess provided in plural including a plurality of first recesses which are adjacent to the first suction hole and spaced apart from each other along the first direction.

6. The shielding bag gripping apparatus of claim 1, wherein the first suction bar further includes the first suction hole provided in plural including a plurality of first suction holes spaced apart from each other along the first direction.

7. The shielding bag gripping apparatus of claim 1, further comprising:

an air supply part which is connected to the air nozzle and provides both a positive pressure and a negative pressure to the air nozzle; and a nozzle driver which is connected to the air nozzle and moves the air nozzle into and out of the first recess of the first suction bar.

* * * * *